US008832974B2

(12) United States Patent
Koch et al.

(10) Patent No.: US 8,832,974 B2
(45) Date of Patent: Sep. 16, 2014

(54) V-PLOW

(75) Inventors: Timothy G. Koch, Slinger, WI (US); Robert N. Gamble, II, Watertown, WI (US); Jacob R. Brehmer, Hartford, WI (US); Mark D. Buckbee, Wauwatosa, WI (US)

(73) Assignee: Sno-Way International, Inc., Hartford, WI (US)

( * ) Notice: Subject to any disclaimer, the term of this patent is extended or adjusted under 35 U.S.C. 154(b) by 209 days.

(21) Appl. No.: 12/140,635

(22) Filed: Jun. 17, 2008

(65) Prior Publication Data

US 2009/0307937 A1 Dec. 17, 2009

(51) Int. Cl.
*E01H 5/06* (2006.01)

(52) U.S. Cl.
CPC ..... *E01H 5/06* (2013.01)
USPC ..... 37/272

(58) Field of Classification Search
USPC ..... 37/272, 217, 269, 271; 74/89.45; 172/821, 822, 823, 824
See application file for complete search history.

(56) References Cited

U.S. PATENT DOCUMENTS

| | | | | | |
|---|---|---|---|---|---|
| 2,059,431 | A | * | 11/1936 | Barrett et al. | 172/823 |
| 3,353,434 | A | * | 11/1967 | Habig et al. | 84/454 |
| 3,410,008 | A | * | 11/1968 | Standfuss | 37/231 |
| 3,432,949 | A | * | 3/1969 | Glesmann | 37/231 |
| 3,436,847 | A | * | 4/1969 | Grimes | 37/231 |
| 3,466,766 | A | * | 9/1969 | Kahlbacher | 37/233 |
| 3,851,894 | A | | 12/1974 | St. Pierre | |
| 3,987,562 | A | * | 10/1976 | Deen et al. | 37/231 |
| 4,074,448 | A | * | 2/1978 | Niemela | 37/234 |
| 4,436,477 | A | | 3/1984 | Lenertz et al. | |
| 4,552,226 | A | * | 11/1985 | Platter | 172/815 |
| 4,658,519 | A | * | 4/1987 | Quenzi | 37/231 |
| 4,843,744 | A | * | 7/1989 | Jansen | 37/232 |
| 4,905,387 | A | * | 3/1990 | Street | 37/271 |
| 4,962,599 | A | * | 10/1990 | Harris | 37/266 |
| 5,092,409 | A | | 3/1992 | Defrancq | |
| 5,195,261 | A | | 3/1993 | Vachon | |
| 5,392,864 | A | * | 2/1995 | Lindenmuth | 172/811 |
| 5,568,694 | A | * | 10/1996 | Capra et al. | 37/231 |
| 5,638,618 | A | * | 6/1997 | Niemela et al. | 37/281 |
| 5,829,174 | A | | 11/1998 | Hadler et al. | |
| 5,894,688 | A | | 4/1999 | Struck et al. | |
| 5,901,793 | A | * | 5/1999 | Frisbee | 172/816 |
| 5,924,223 | A | | 7/1999 | Hone, Jr. | |
| 5,960,569 | A | * | 10/1999 | Molstad | 37/231 |
| 6,035,944 | A | | 3/2000 | Neuner et al. | |
| 6,044,579 | A | | 4/2000 | Hadler et al. | |
| 6,088,937 | A | * | 7/2000 | DiClementi et al. | 37/232 |

(Continued)

*Primary Examiner* — Abigail A Risic
(74) *Attorney, Agent, or Firm* — Reinhart Boerner Van Deuren s.c.

(57) ABSTRACT

A snow plow is provided with a first V-plow blade and a second V-plow blade each pivotably coupled to a plow tower with a horizontal pivot pin. The snow plow includes a hitch frame nose assembly configured to couple to a vehicle by securing each of a chassis coupler to the vehicle chassis. The two V-plow blades are coupled to a plow tower configured to support each of the V-plow blades for movement about a blade vertical pivot pin disposed in each of the first and second V-plow blades and the plow tower. A tower adjustment assembly is coupled to the plow tower and a plow frame which is configured to couple to the hitch frame nose assembly. A lift bar assembly is coupled to the rear portion of the plow frame and couples to the hitch frame nose assembly wherein the snow plow is pivotably coupled to the vehicle.

16 Claims, 17 Drawing Sheets

(56) References Cited

U.S. PATENT DOCUMENTS

| | | | | |
|---|---|---|---|---|
| 6,108,946 | A * | 8/2000 | Christy | 37/272 |
| 6,145,222 | A | 11/2000 | Curtis | |
| 6,151,808 | A | 11/2000 | Curtis | |
| 6,154,986 | A | 12/2000 | Hadler et al. | |
| 6,178,669 | B1 * | 1/2001 | Quenzi et al. | 37/231 |
| 6,209,231 | B1 | 4/2001 | Curtis | |
| 6,240,659 | B1 | 6/2001 | Curtis et al. | |
| 6,253,470 | B1 * | 7/2001 | Depies et al. | 37/234 |
| 6,314,666 | B1 | 11/2001 | Klemenhagen et al. | |
| 6,363,629 | B1 | 4/2002 | Curtis | |
| 6,408,549 | B1 * | 6/2002 | Quenzi et al. | 37/281 |
| 6,526,677 | B1 * | 3/2003 | Bloxdorf et al. | 37/231 |
| 6,557,275 | B2 | 5/2003 | Curtis | |
| 6,594,924 | B2 | 7/2003 | Curtis | |
| 6,615,513 | B2 | 9/2003 | Quenzi et al. | |
| 6,618,964 | B2 | 9/2003 | Kost et al. | |
| 6,691,435 | B1 | 2/2004 | Schultz et al. | |
| 6,711,837 | B2 | 3/2004 | Bloxdorf et al. | |
| 6,775,933 | B2 | 8/2004 | Koch et al. | |
| 6,928,757 | B2 | 8/2005 | Bloxdorf et al. | |
| 6,941,685 | B2 | 9/2005 | Goy et al. | |
| 6,944,978 | B2 | 9/2005 | LeBlond et al. | |
| 6,964,121 | B2 | 11/2005 | Harris | |
| 7,103,995 | B2 | 9/2006 | Curtis | |
| 7,117,617 | B2 | 10/2006 | Kost et al. | |
| 7,146,754 | B2 | 12/2006 | Schultz et al. | |
| 7,228,650 | B2 | 6/2007 | Curtis | |
| 7,334,357 | B1 | 2/2008 | Altheide | |
| 7,353,628 | B2 * | 4/2008 | Potak | 37/231 |
| 2004/0088892 | A1 | 5/2004 | Kost et al. | |
| 2004/0172858 | A1 | 9/2004 | Bloxdorf et al. | |
| 2005/0039968 | A1 | 2/2005 | Lashua | |
| 2005/0076543 | A1 | 4/2005 | Curtis | |
| 2005/0120595 | A1 | 6/2005 | Bloxdorf et al. | |
| 2005/0144814 | A1 | 7/2005 | Potak | |
| 2006/0055150 | A1 | 3/2006 | Curtis | |
| 2007/0051021 | A1 | 3/2007 | Kost et al. | |
| 2008/0073090 | A1 | 3/2008 | Harris | |
| 2008/0115392 | A1 | 5/2008 | Musso et al. | |

* cited by examiner

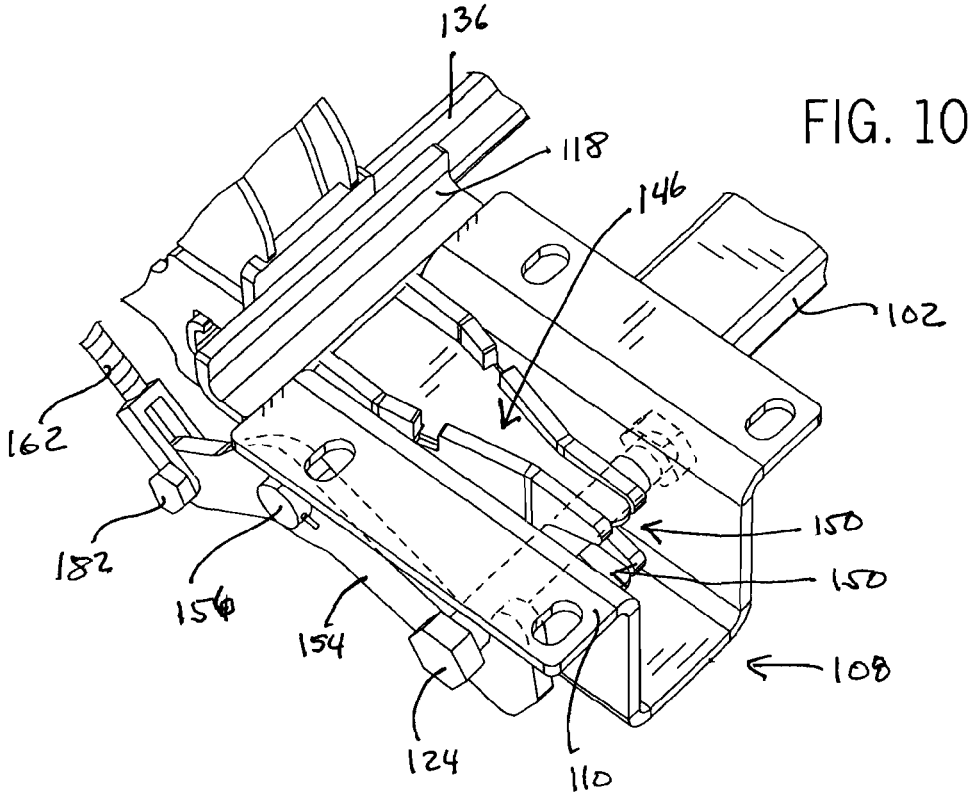
FIG. 10
FIG. 11
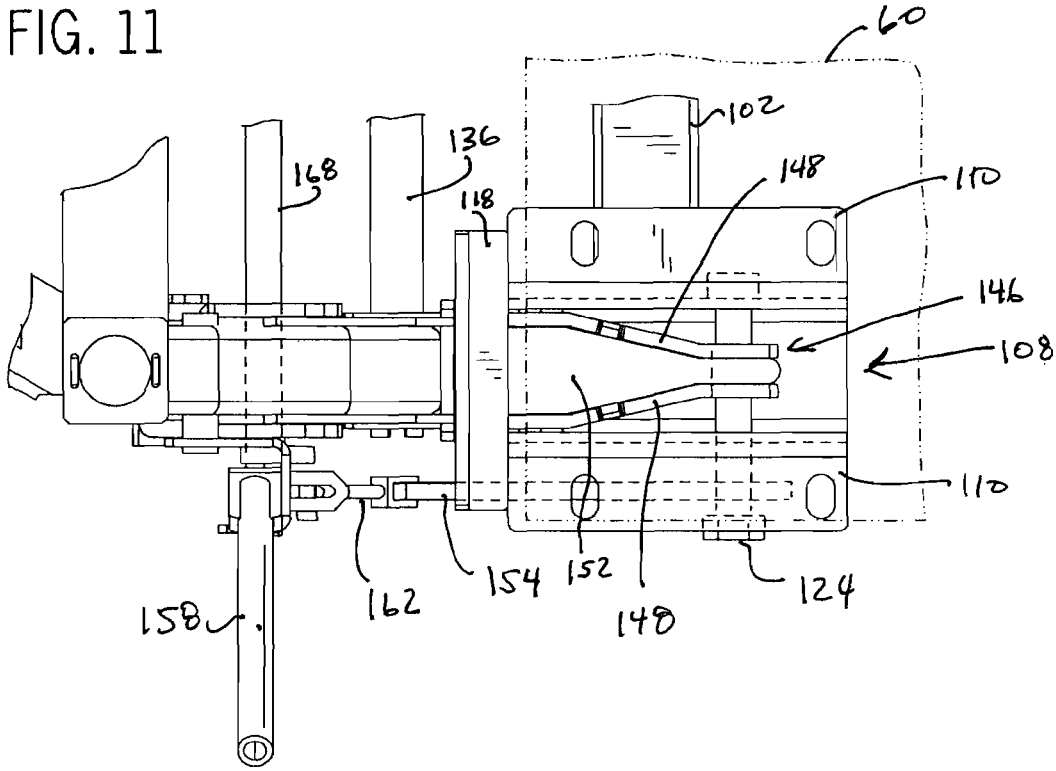

FIG. 19
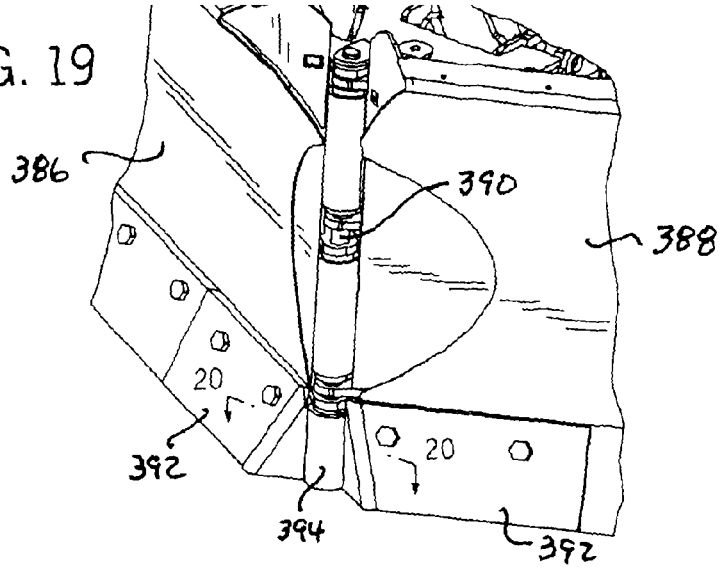
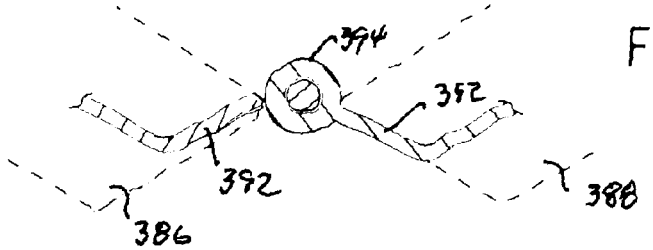
FIG. 20
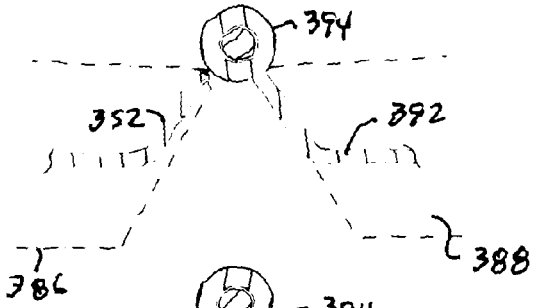
FIG. 21
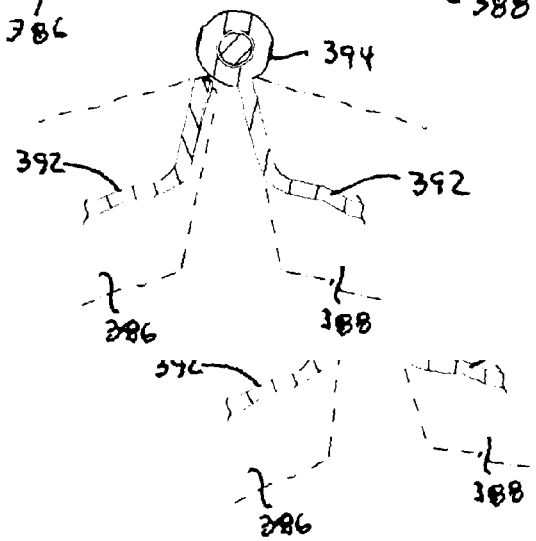
FIG. 22

V-PLOW

IDENTIFICATION OF RELATED APPLICATIONS

This patent application is related to co-pending U.S. patent application Ser. No. 12/140,903, entitled "Snow Plow Jack Stand," co-pending U.S. patent application Ser. No. 12/140,893, entitled "Removable And Storable Wings For A Snow Plow Blade And Snow Removal System Used Therewith," co-pending U.S. patent application Ser. No. 12/140,886, entitled "Snow Plow Blade Including Nut Retaining Plate," co-pending U.S. patent application Ser. No. 12/140,732, entitled "Plow Quick Connect/Disconnect Hitch Mechanism," and co-pending U.S. patent application Ser. No. 12/140,671, entitled "Plow Including Independently Moveable Wings," all of which patent applications were filed on Jun. 17, 2008, and all of which patent applications are assigned to the assignee of the present application, and all five of which patent applications are hereby incorporated herein by reference in their entirety.

BACKGROUND OF THE INVENTION

Field of the Invention

The present invention relates generally to material handling equipment, and more particularly to a plow with a hitch mechanism configured to be easily and quickly coupled to a vehicle and the plow including independently moveable wings.

It is known that plows, for example snow plows, are bolted to supports which are typically welded to the chassis of a vehicle, for example a truck. It is also known that a plow support can be bolted to the chassis of a vehicle. Since plows typically weigh hundreds of pounds, positioning the plow for attachment to the vehicle can be difficult. It is particularly difficult to maneuver a snow plow in the cold and snow of winter.

It is also known to provide a V-Plow in which two blade segments are positioned in a V-shape with the blade segments swept to the rear. Where the blade segments come close together a gap exists through which material, such as snow, can move. It is known, for example, to overlap the blade segments or place a flexible covering in front of the gap. Such configurations are not satisfactory and need replacement or high maintenance activity.

Accordingly, it is desirable to provide a plow hitch mounting mechanism which is easy to maintain and that the process of connecting and disconnecting the plow to or from the vehicle is simple and easy to use by one person without assistance. It is also desirable to provide a V-plow having a minimum gap between the two V-plow segments and providing an adjustment apparatus to facilitate maintaining the blade bottom edges in horizontal alignment along their length.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, all of the aforesaid advantages should be achieved without incurring any substantial relative disadvantage.

SUMMARY OF THE INVENTION

The disadvantages and limitations of the background art discussed above are overcome by the present invention.

There is provided a snow plow which includes a hitch frame nose assembly configured to a vehicle. The hitch frame nose assembly includes a chassis coupler secured at each end of a chassis tube with each chassis coupler including a traverse pin is configured to attach to the vehicle chassis. A plow frame having a front portion and a rear portion is coupled to a plow tower configured to support each of a first V-plow blade and a second V-plow blade pivotably coupled to the plow tower with a horizontal pivot pin. The plow tower is configured to support each of the V-plow blades for movement about a blade vertical pivot pin disposed in each of the first and second V-plow blades and the plow tower. A tower adjustment assembly is coupled to the plow tower and the plow frame, with the tower adjustment assembly configured to adjust the orientation of the two V-plow blades about the horizontal pivot pin. A lift bar assembly is coupled to the rear portion of the plow frame. The lift bar assembly includes a pair of notched members with each notched member aligned with a corresponding chassis coupler and configured to engage the traverse pin in each of the chassis couplers, wherein the snow plow is pivotably coupled to the vehicle. In another embodiment, the tower adjustment assembly includes an adjustment cushion plug positioned within an outer adjustment tube in an operative contact with an inner adjustment positioned within the outer adjustment tube, wherein upon compression of the adjustment cushion plug a force is transmitted to the inner adjustment tube and rotates the plow tower about the horizontal pivot pin.

The apparatus of the present disclosure is of a construction which is both durable and long lasting, and which will require little or no maintenance to be provided by the user throughout its operating lifetime. The apparatus of the present disclosure is also of inexpensive construction to enhance its market appeal and to thereby afford it the broadest possible market. Finally, all of the aforesaid advantages and objectives are achieved without incurring any substantial relative

DESCRIPTION OF THE DRAWINGS

These and other advantages of the present invention are best understood with reference to the drawings, in which:

FIG. 10 is a detail perspective view of a chassis coupler engaged with a notched member of the hitch frame mechanism illustrated in FIG. 3.

FIG. 11 is a top view of the chassis coupler illustrated in FIG. 10.

FIG. 19 is a detail front view of an exemplary embodiment of a pivot for the first and second V-blades illustrated in FIG. 18.

FIG. 20 is a cross-sectional top view of the lower pivot portion along the line 20-20 in FIG. 19 and illustrating the alignment of the first and second V-plow blades in a swept-back position.

FIG. 21 is a cross-sectional top view of the lower pivot portion along the line 20-20 in FIG. 19 and illustrating the alignment of the first and second V-plow blades in a straight line position.

FIG. 22 is a cross-sectional top view of the lower pivot portion along the line 20-20 in FIG. 19 and illustrating the alignment of the first and second V-plow blades in a swept-forward position.

DETAILED DESCRIPTION OF THE EXEMPLARY EMBODIMENTS

There is disclosed a snow plow 50 for mounting on a vehicle 60 with a quick connection/disconnect hitch 70 (more fully described below). The quick connect/disconnect hitch 70 facilitates the easy connection, i.e., without tools and disconnection of the snow plow 50 from the vehicle 60.

Figures 1, 2:
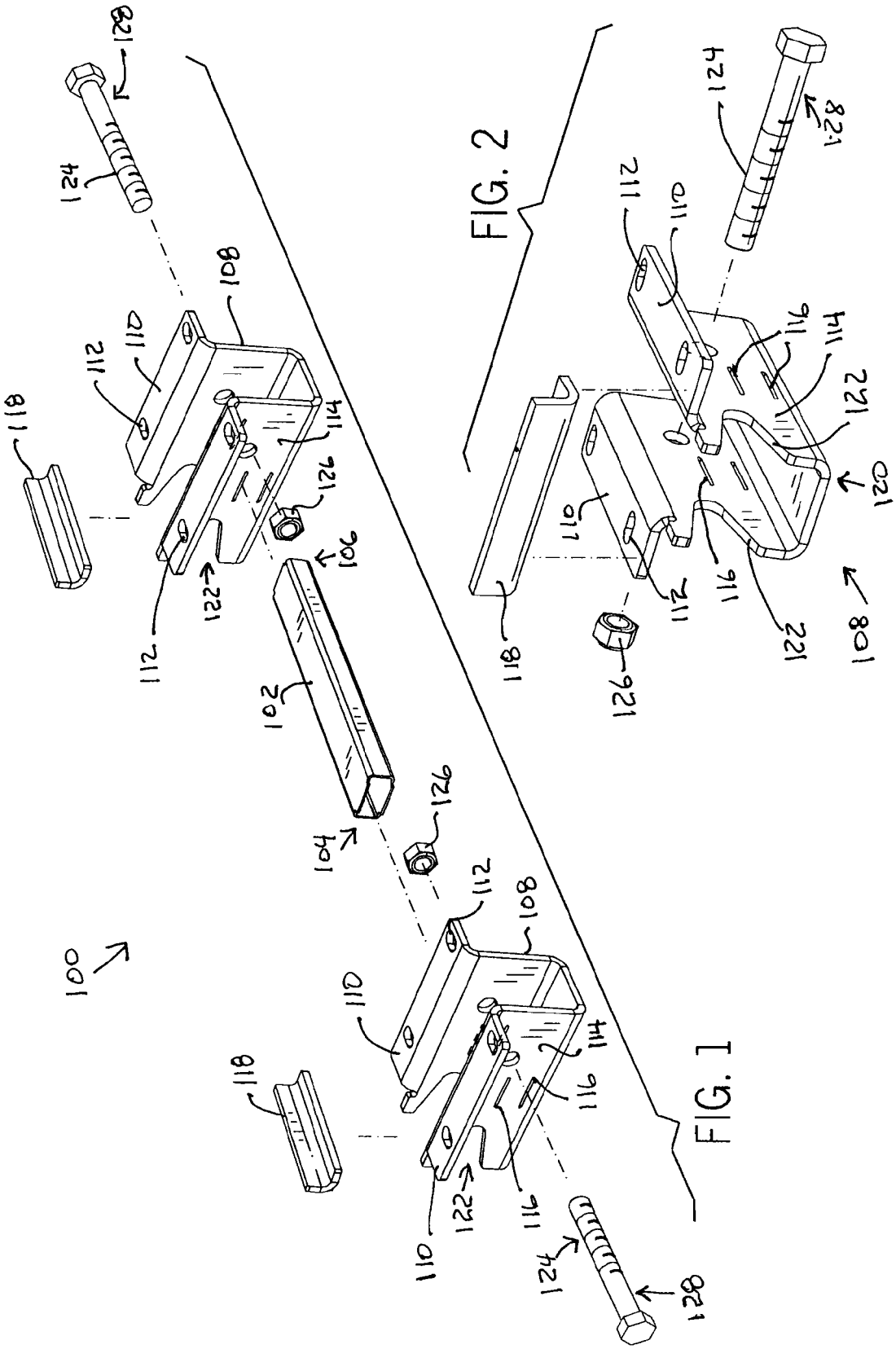
FIG. 1 is an exploded, isometric view of an exemplary embodiment of a hitch frame nose assembly.
FIG. 2 is a detail view of an exemplary embodiment of a chassis coupler of the hitch frame nose assembly illustrated in FIG. 1.

Referring to FIGS. 1 and 2, a hitch frame nose assembly 100 includes a hitch frame tube having a first end 104 and a second end 106. Coupled to each end of the hitch nose tube 102 is a chassis coupler 108. Each chassis coupler 108 mounts to the vehicle chassis 60. In a typical set up, each of the chassis couplers 108 will be secured to a frame member of the vehicle chassis 70 (not shown) by bolting the chassis coupler 108 to the vehicle chassis 60. It is also contemplated that the chassis coupler 108 can be welded to the vehicle chassis 60 as determined by the user of the quick connect/disconnect hitch 70.

Each chassis coupler 108 is a formed U-shaped channel with outward extending flanges. The flanges 110 are configured to provide a mounting surface for the chassis coupler 108 to facilitate coupling of the chassis coupler 108 to the vehicle chassis 60. Each flange 110 defines a plurality of apertures 112 to facilitate bolting of the chassis coupler 108 to the vehicle chassis 60. The apertures 112 may be configured as circles or slots. Each side 114 of each chassis coupler 108 further defines a pair of slots 116 extending longitudinally along and through each side 114 of the chassis coupler 108. The slots 116 facilitate the coupling of the hitch frame tube 102 to each of the chassis couplers 108 comprising the hitch frame nose assembly 100. Each chassis coupler 108 may be provided with slots 116 on each side 114 of the chassis coupler 108 to facilitate manufacturing and assembly by providing commonality of parts. Each chassis coupler 108 is also provided with an end-stop coupled to each of the flanges 110 proximate the front end 120 of the chassis coupler 108. The end-stop 118 assists in positioning the chassis coupler 108 on the vehicle chassis 60. Each chassis coupler 108 also defines a substantially V-shaped notch 122 to accommodate a lock hook pivot more fully described below. Each chassis coupler 108 also includes a traverse pin 124 which extends through both sides 114 of the chassis coupler 108. Traverse pin 124 is secured to the chassis coupler 108 by a nut 126 threadingly fastened to the traverse pin 124. The nut may further be welded to the chassis coupler 108 to further secure the traverse pin 124. A portion 128 of the traverse pin extends beyond the side 114 of the chassis coupler 108 and is configured to engage a locking hook more fully described below.

Figure 3A:
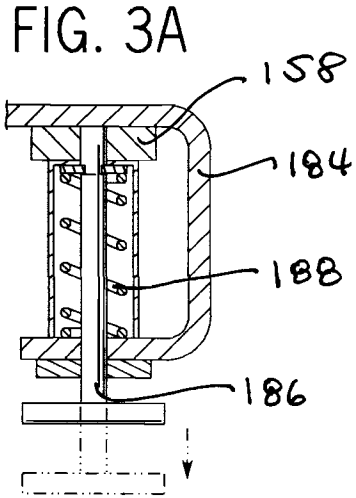
FIG. 3A is a cross-sectional view of an exemplary embodiment of a spring biased retaining pin along the line 3A-3A of FIG. 3.
Figure 3:
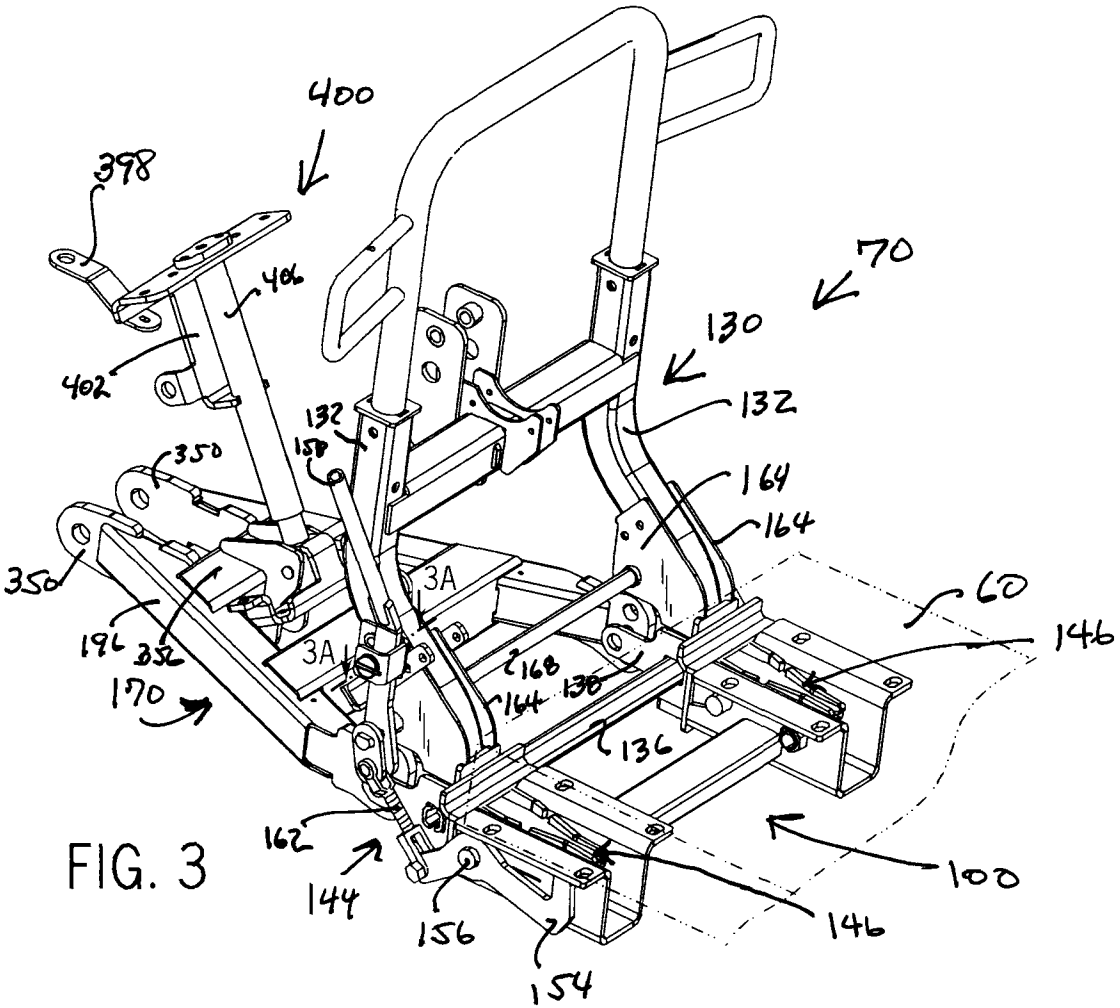
FIG. 3 is an isometric rear view of an exemplary embodiment of a hitch mechanism coupled to a vehicle.

FIG. 3 illustrates an exemplary embodiment of a quick connect/disconnect hitch 70 assembly. The hitch frame nose assembly 100 is coupled to a vehicle chassis 60. Coupled to the hitch frame nose assembly 100 is the lift bar assembly 130 which in turn is coupled to a plow frame 170.

Figure 12:
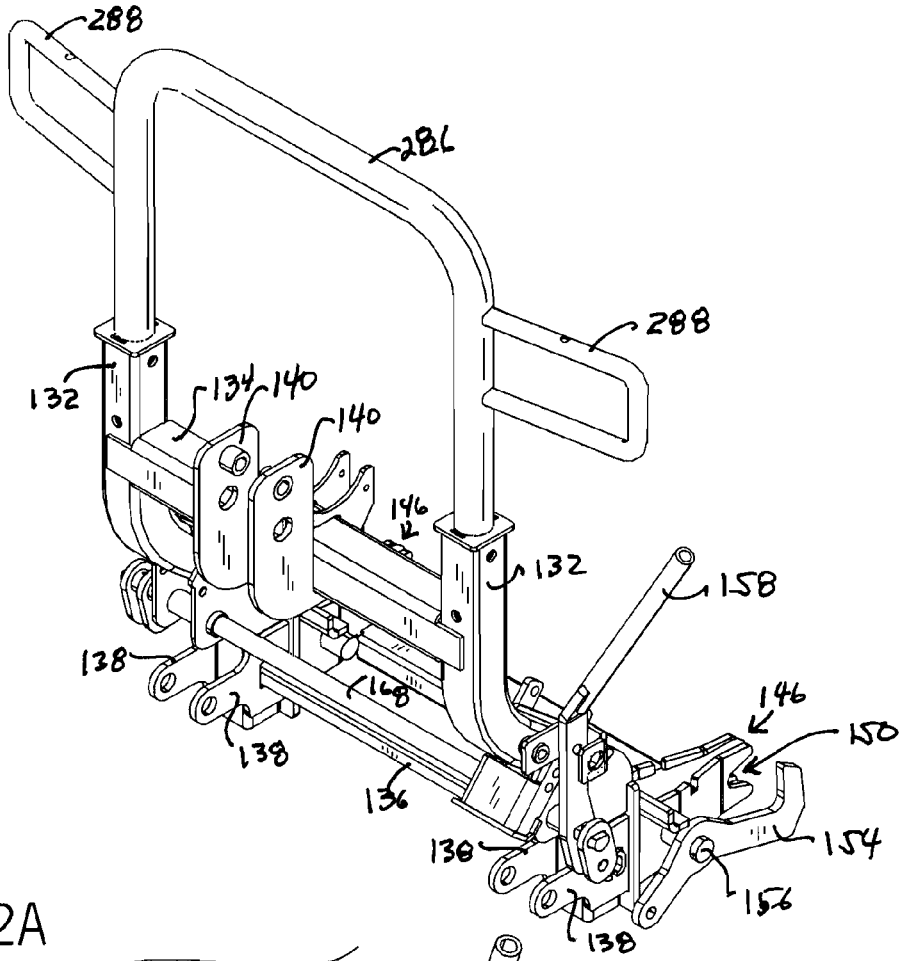
FIG. 12 is an isometric rear view of an exemplary embodiment of a lift bar assembly of the hitch mechanism illustrated in FIG. 3.
Figure 12A:
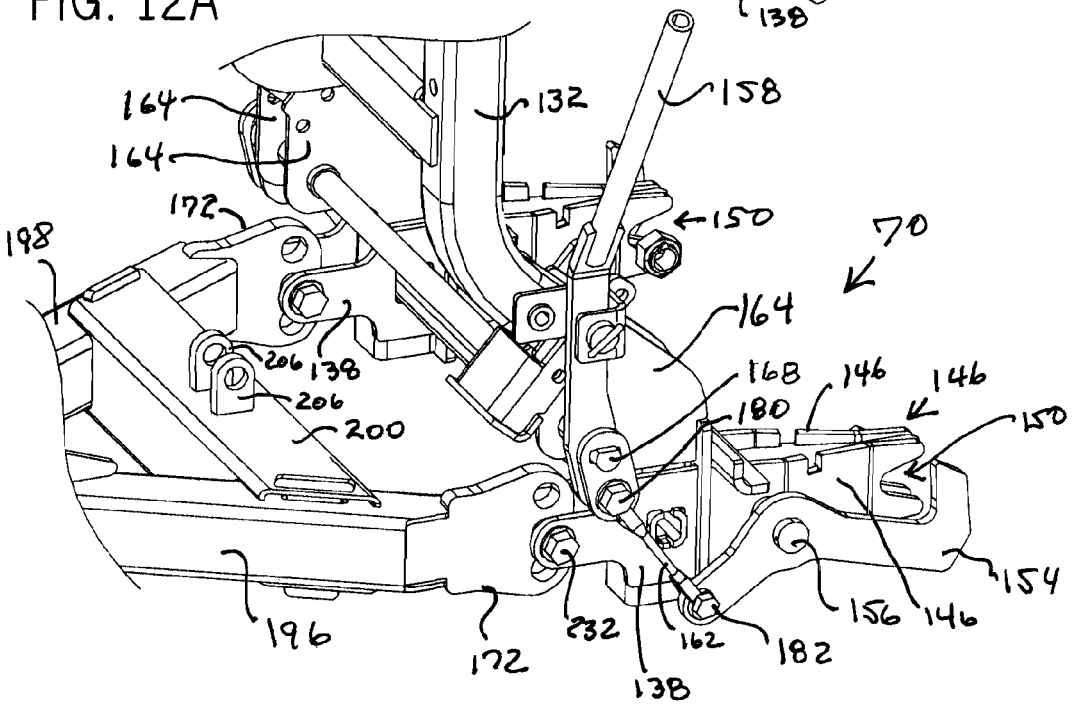
FIG. 12A is a partial view of the lift bar assembly illustrated in FIG. 12, illustrating the lift bar assembly coupled to the rear portion of a plow frame in one of a plurality height adjustment orifices.
Figure 12B:
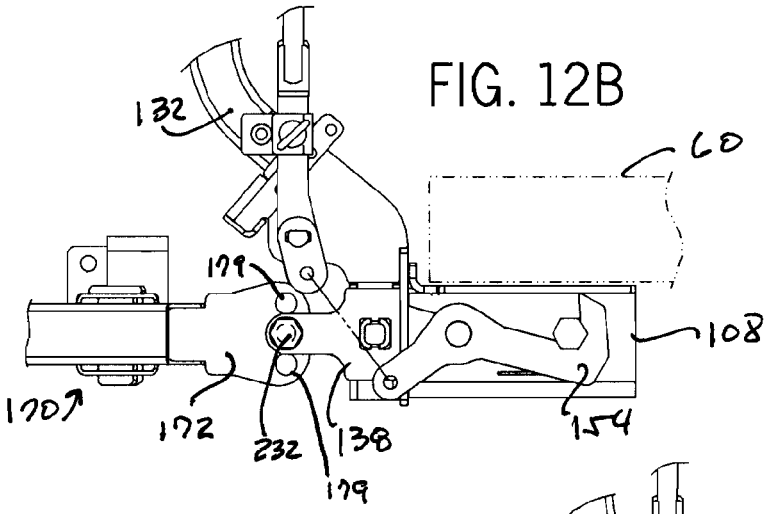
FIG. 12B is a partial side elevation of the hitch mechanism illustrated in FIG. 3.
Figure 12C:
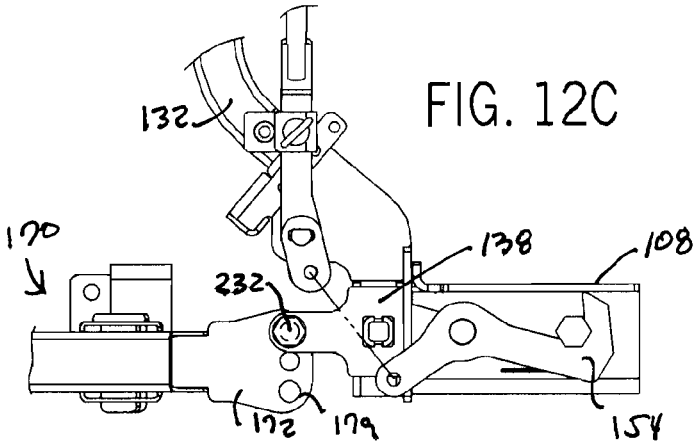
FIG. 12C is a partial side elevation of the hitch mechanism illustrated in FIG. 3 with the lift bar assembly coupled to the plow frame in an alternative height adjustment orifice.

The lift bar assembly 130 includes a pair of lift bar support members 132 maintained in a spaced apart relationship and coupled to a lift bar approximate the top of each lift bar support member 132. A light bar brace 136 approximate the lower end of each lift bar support member 132 facilitates maintenance of the spaced apart relationship of the lift bar support member 132. A pair of lift bar lugs 138 are coupled to each lift bar support member 132 approximate the light bar brace 136. (Also see FIGS. 12 and 12*a*). Coupled to the lift bar 134 are a pair of upper lift cylinder mounts 140 configured to operably secure a power mechanism, for example a lift cylinder 142. Also coupled to the lift bar assembly 130 is a locking mechanism 144.

Figure 4:
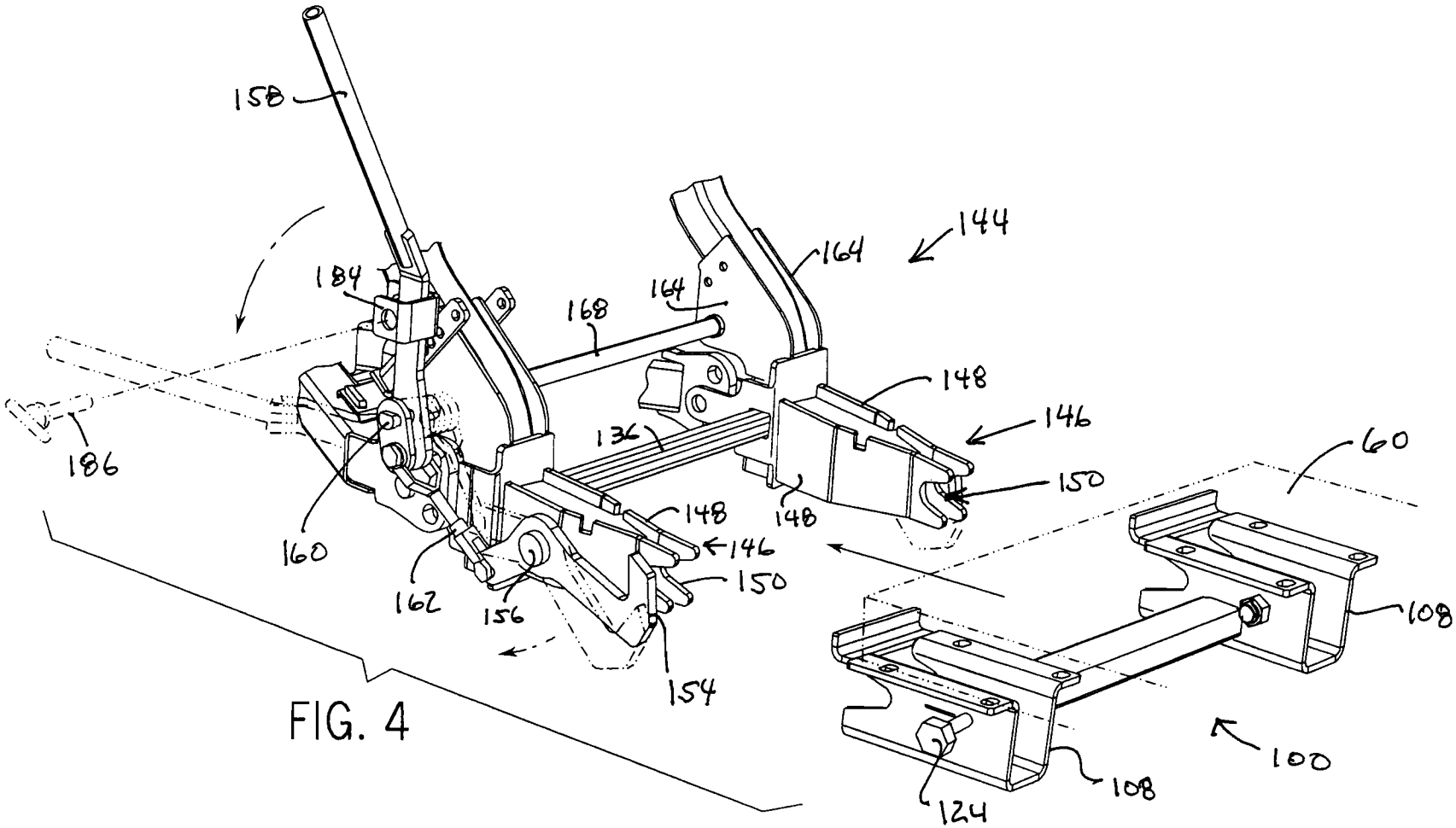
FIG. 4 is an isometric view of the hitch mechanism illustrated in FIG. 3 uncoupled from the hitch frame nose assembly.

Referring to FIG. 4, there is illustrated a hitch frame nose assembly 100 coupled to a vehicle chassis 60 and positioned to receive a locking mechanism 144 of a quick connect/disconnect hitch 70. The locking mechanism 144 includes a pair of notched members 146 coupled to the lift bar assembly 130 and positioned to correspond for engagement with each of the chassis couplers 108 of the hitch frame nose assembly 100.

Each notch member 146 includes a pair of tapered side members 148 with each tapered side member 148 defining a notch 150. Each notch 150 is configured to engage the traverse pin 124 positioned between the two sides 114 of each chassis coupler 108. Each notch member 146 also includes a plate member 152 fastened to the top portion of each of the tapered side members 148, typically by welding a plate member 150 to each tapered side member 148. The plate member provides additional reinforcement for the notch member 146 and defines with the two tapered side members 148 an inverted U-shape assembly. With the notch member 146 engaged with the chassis coupler 108 the pivot for the quick connect/disconnect hitch 70 formed by the engagement of the notch 150 with the traverse pin 124 is enclosed within the two facing u-shaped assemblies.

Each notched member 146 further includes a locking hook 154 pivotally coupled to a hook pivot 156. The hook pivot 156 extends through each of the tapered side members 148 of each notch member 146. The locking hook 154 moves about the hook pivot 156 in response to movement of the hitch locking lever 158 as the hitch locking lever 158 moves about a lever pivot 160. The hitch locking lever 158 is coupled to the locking hook 154 by a lock linkage 162. The operation of the locking mechanism 144 will be explained below.

The orientation of the locking hook 154 and the notch member 146 is such that when the notch member 146 is inserted into the chassis coupler 108 the locking hook is positioned outside of the unshaped chassis coupler 108 and positioned to selectively engage the portion 128 of the traverse pin 124 that extends beyond the side 114 of the chassis coupler 108. It should be understood that there is a locking hook 154 on each of the notch members 146 which engages the traverse pin 124 extending beyond the side 114 of each of the chassis couplers 108 that are part of the hitch frame nose assembly 100. The locking hook 154 locks the lift bar assembly 130 to the hitch frame nose assembly 100.

Locking mechanism 144 also includes a lock support bracket 164 which is coupled to each of the lift bar support members 132. A preferred embodiment provides that a pair of lock support brackets 164 are coupled to each side of the corresponding lift bar support member 132. (FIGS. 3 and 4). It should be understood that the locking mechanism 144 includes a locking hook 154, hook pivot 156, lock linkage 162 on each outward side of the lift bar assembly 130. On one side of the lift bar assembly 130, the hitch locking lever 158 is coupled to the linkage, and on the other side of the lift bar assembly 130 the lock linkage 162 is coupled to a lock linkage bracket 166. (See FIG. 9). The lock linkage bracket 166 and the hitch locking lever 158 are coupled together by a hitch lock extension rod 168 extending through each of the lock support brackets 164 and each of the lift bar support members 132. The hitch lock lever 158 and the lock linkage bracket 166 are journaled to the hitch lock extension rod 168 by a flat face defined on each end of the hitch lock extension rod 168. (See FIGS. 8 and 9).

Figure 5:
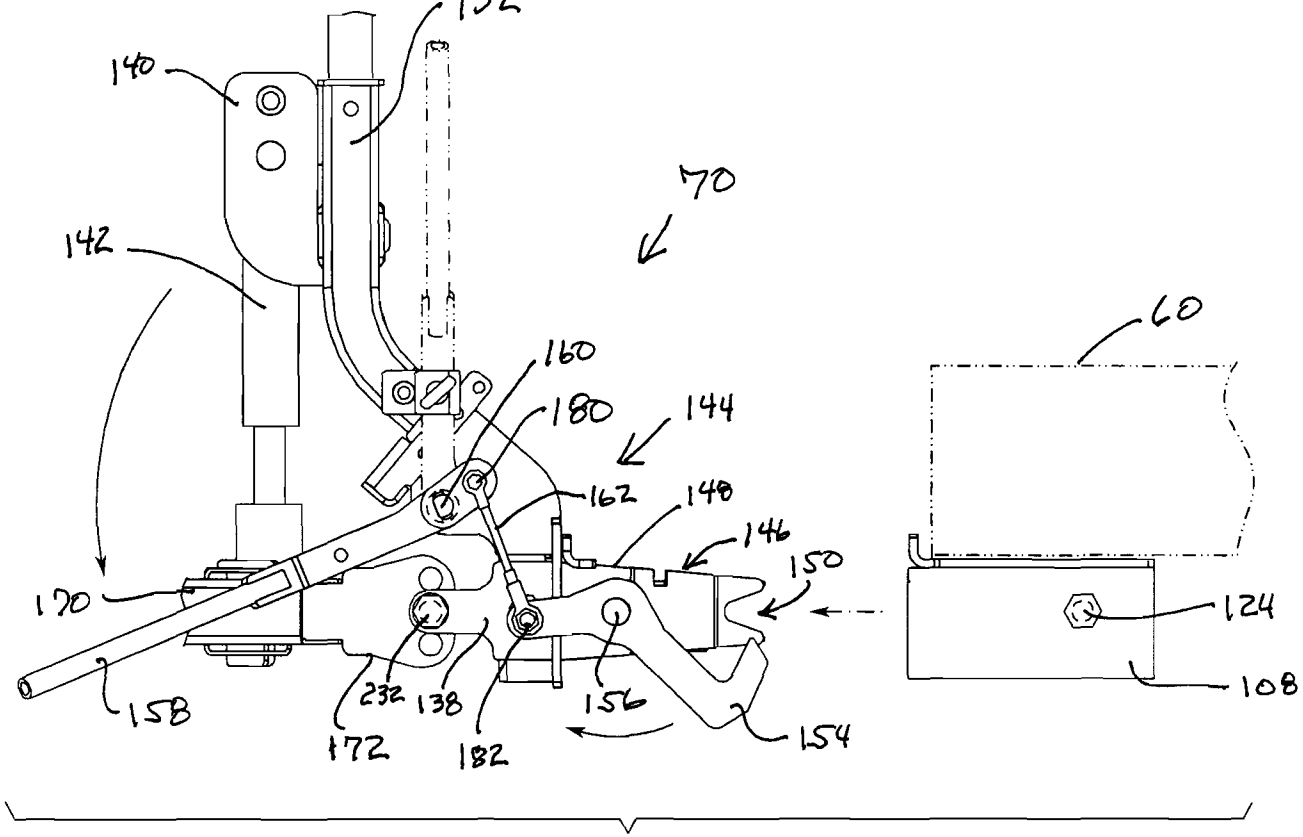
FIG. 5 is a side elevation of the hitch mechanism illustrated on FIG. 4.

The operation of coupling the quick connect/disconnect hitch 70 to the vehicle chassis 60 will now be described with reference to FIGS. 5 through 9. FIG. 5 illustrates an exemplary embodiment of a quick connect/disconnect hitch 70 positioned to engage the hitch frame nose assembly 100 coupled to a vehicle chassis 60. The hitch locking lever 158 is in an unlocked position 174. The movement of the hitch lock lever 158 to the unlocked position 174 rotated the locking hook as illustrated in FIG. 5. The vehicle having a hitch frame nose assembly 100 coupled to the vehicle chassis 60 is moved towards the quick connect/disconnect hitch 70 as indicated by the arrow in FIG. 5.

Figure 6:
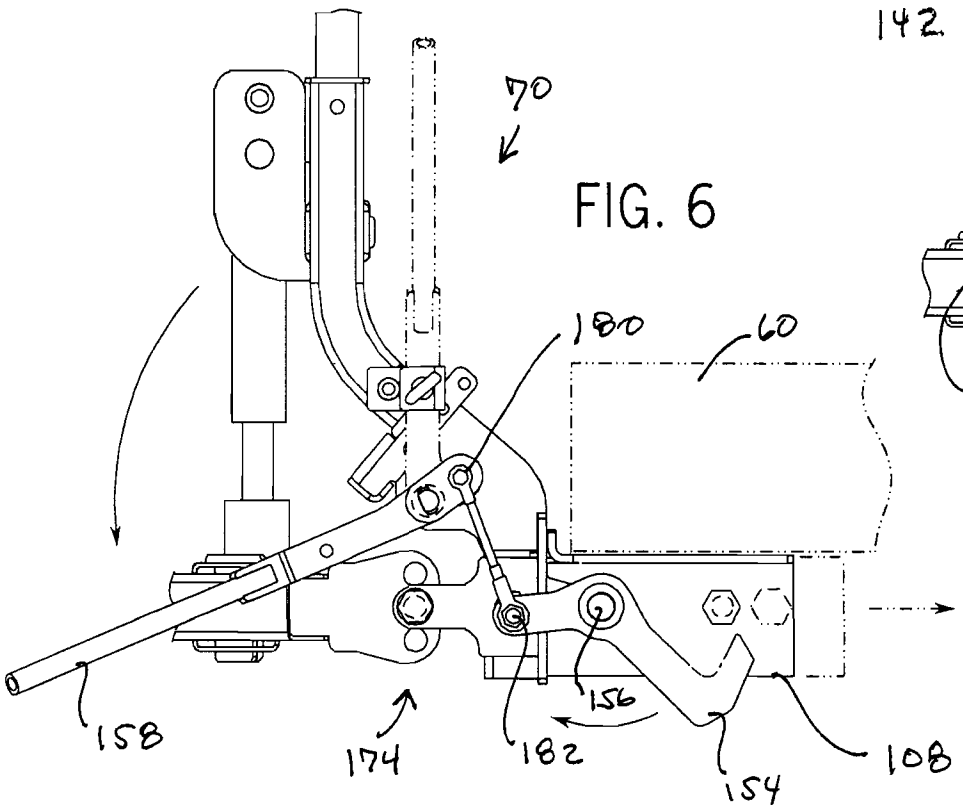
FIG. 6 is a side elevation of the hitch mechanism illustrated in FIG. 3 with the hitch mechanism configured to uncouple from the hitch frame nose assembly.

FIG. 6 illustrates the quick connect/disconnect hitch 70 engaged with the hitch frame nose assembly 100 with each notched member 146 of the lift bar assembly 130 coupled to the traverse pin 124 in each of the chassis couplers 108. Such engagement is illustrated at least in FIGS. 10 and 11. In this position, with the hitch locking lever 158 still in the unlocked position 174 the vehicle can be moved away from the hitch 70 if additional adjustment maneuvers are necessary.

Figure 7:
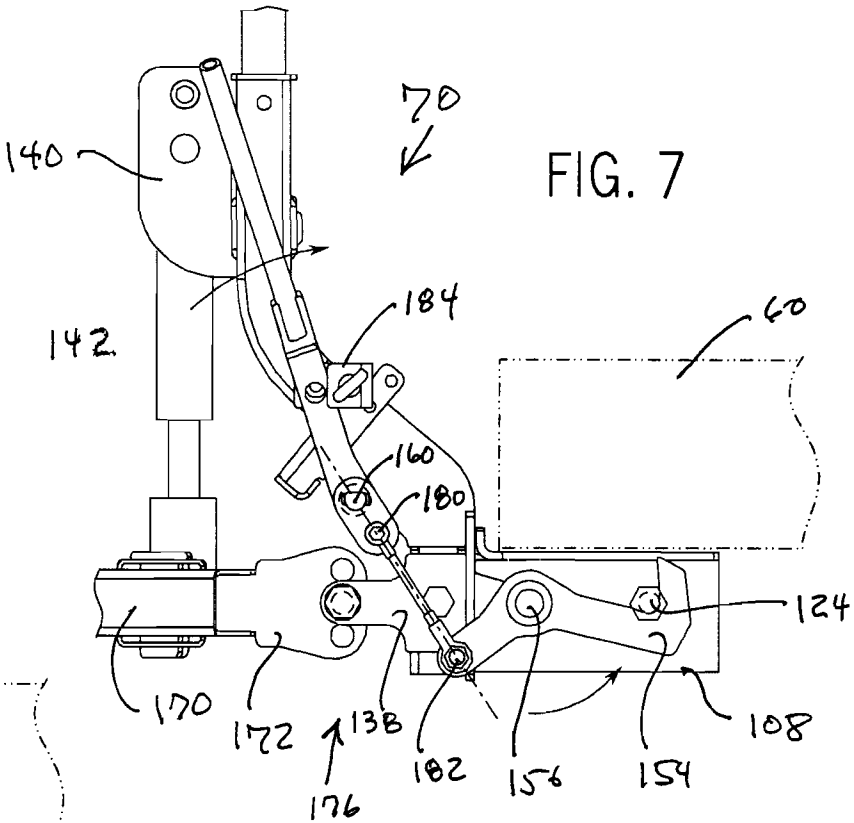
FIG. 7 is side elevation of the hitch mechanism illustrated in FIG. 3 with the hitch mechanism coupled to a chassis coupler of the hitch frame nose assembly and illustrating the hitch locking lever in a first lock position.

FIG. 7 illustrates the locking mechanism 144 in a first locked position 176. In the first locked position 176, the locking hook has moved to engage the traverse pin 124 in each of the chassis couplers 108. In this configuration, the lever pivot 160, the hitch locking lever linkage attachment 180 and the hook linkage attachment 182 are substantially in a straight line as illustrated in FIG. 7.

Figure 8:
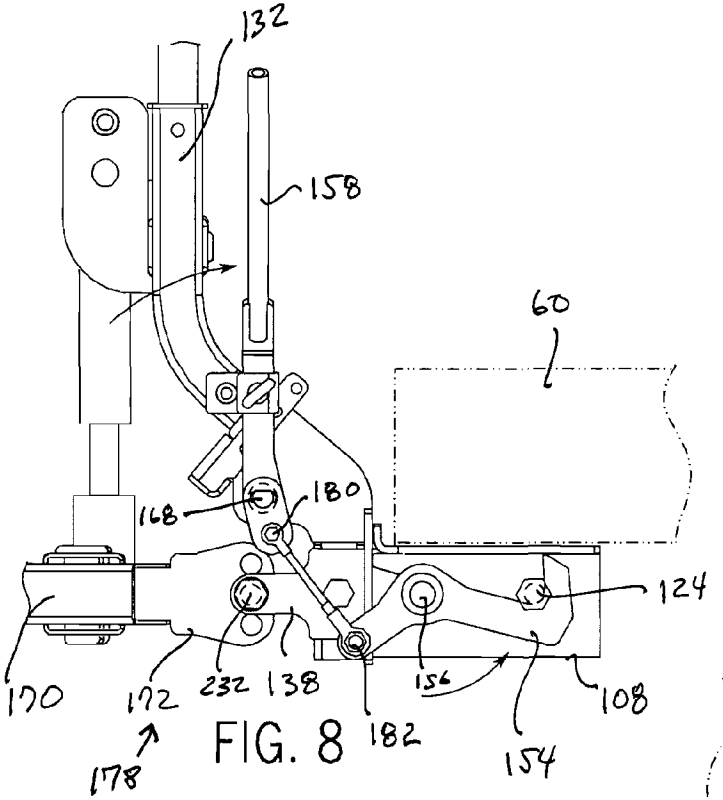
FIG. 8 is a side elevation of the hitch mechanism illustrated in FIG. 7 and illustrating the hitch locking lever in a second lock position.

To complete the locking maneuver of the locking mechanism 144, the hitch locking lever 158 is moved to a second locked position 178 which forces the hitch locking lever 158 to move over center of the lever pivot 160 as illustrated in FIG. 8. The hitch locking lever 158 also is secured in a retaining bracket 184 coupled to a locked support bracket 164. The retaining bracket 184 includes a retaining pin 186 which is biased by a spring 188. The retaining pin 186 engages an orifice defined in the hitch lever locking lever 158 as illustrated in FIG. 3A. It should be understood that other ways of securing the locking lever 158 can be used to prevent the locking lever 158 from inadvertently unlocking the hitch 70.

Figure 9:
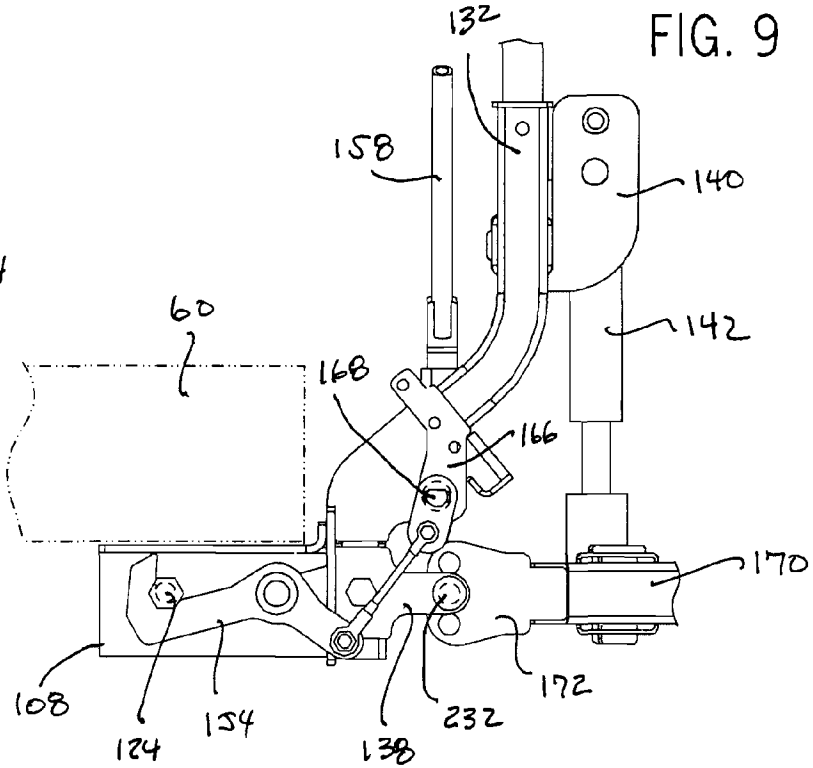
FIG. 9 is a side elevation of another side of the hitch mechanism illustrated in FIG. 8.

As described above, the locking mechanism 144 includes a lock hook 154 on each side of the lift bar assembly 130 and are coupled together to simultaneously operate with movement of the hitch locking lever 158. FIG. 9 illustrates the other side of the locking mechanism 144 illustrated in FIG. 8.

The lift bar assembly 130 is coupled to a plow frame 170. The lift bar assembly 130 is provided with a pair of lift bar lugs 138 coupled to the lift bar brace 136 and to each of the lock support brackets 164 on both sides of the lift bar assembly 130 (see FIG. 12).

A plow frame 170 is configured substantially in the form of a letter A with the plow frame 170 including a front portion 175 and a rear portion 177. The plow frame 170 includes two side member 196, 198 which form the sides of the A-shape with a traverse brace tube 200 coupled to each of the side members 196, 198. A tower traverse brace tube 354 is also coupled to each of the side members 196, 198 and positioned in a spaced apart distance from the traverse brace tube 200 proximate the front portion 175 of the plow frame 170. The side members 196, 198, the tower traverse brace tube 354, and the traverse brace tube 200 are conventional steel square tubing, however, it is contemplated that other cross-section configured tubes, for example circular or triangular, can be used. Coupled to the front portion 175 of the plow frame 170 are a pair of horizontal blade pivot brackets 350. The brackets 350 are coupled to the respective side member 196, 198 and the tower traverse brace tube 354. Each of the brackets 350 defines an orifice 352 configured to receive a horizontal blade pivot pin 370.

Figure 13:
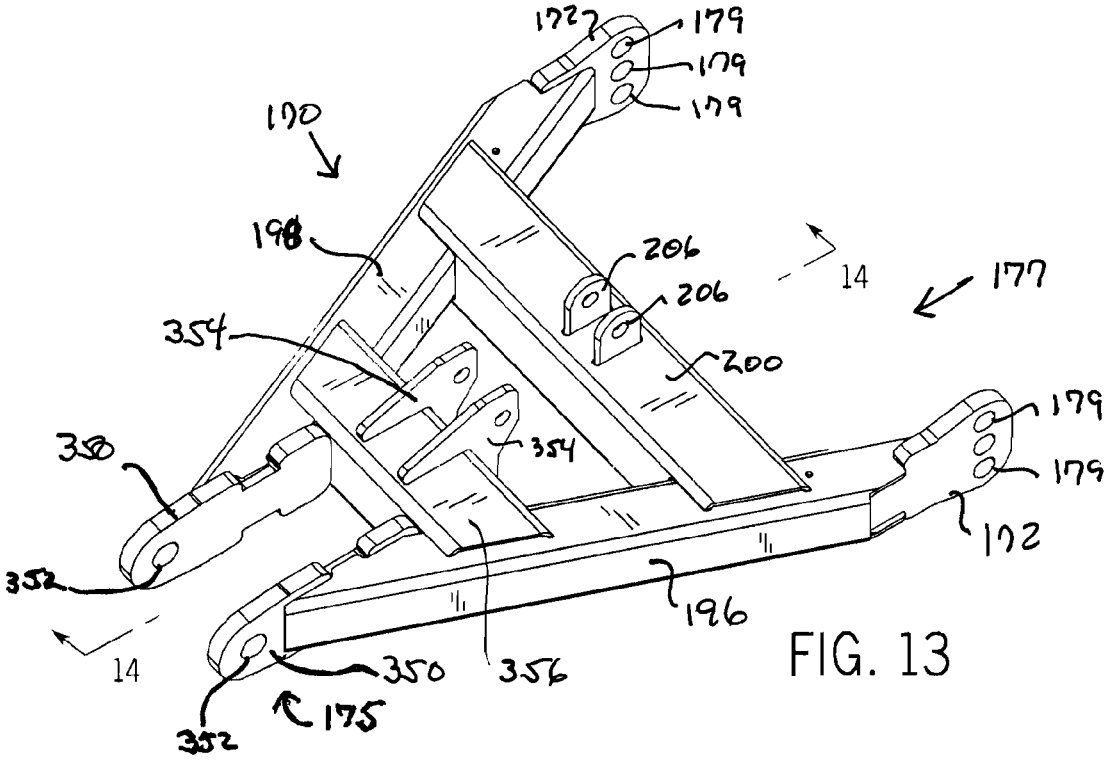
FIG. 13 is an isometric, top, front view of an exemplary embodiment of an A-frame plow frame assembly of the hitch mechanism illustrated in FIG. 3.
Figure 14:
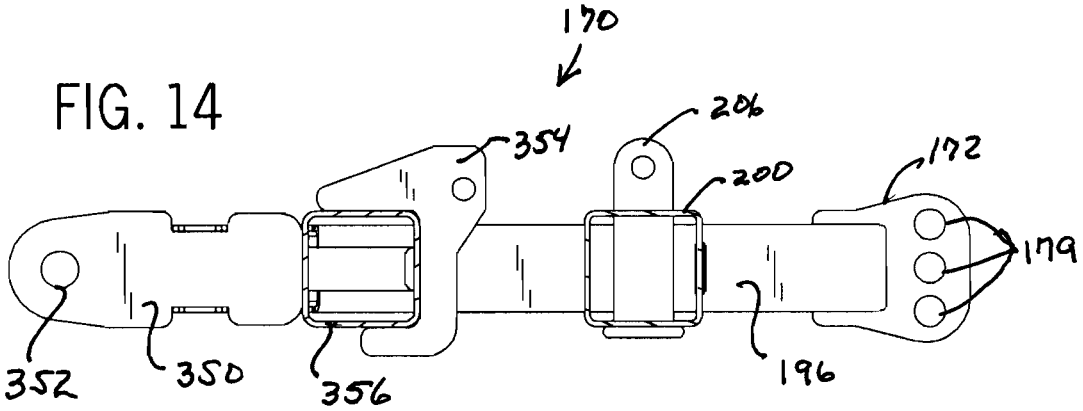
FIG. 14 is a cross sectional view of the plow frame illustrated in FIG. 13 along the line 14-14.
Figure 15:
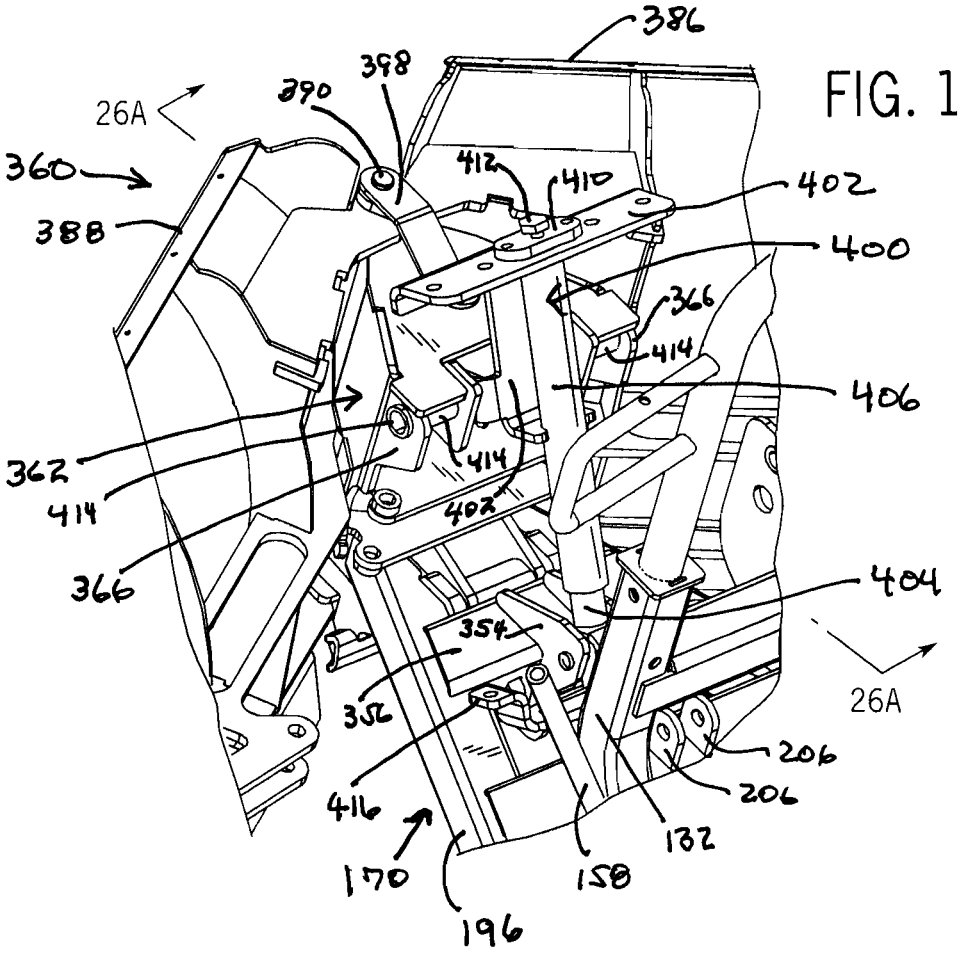
FIG. 15 is a partial rear view of an exemplary embodiment of a plow tower and tower adjustment assembly of the hitch mechanism illustrated in FIG. 3.

A pair of lower tower adjustment brackets 354 are coupled, for example by welding, to the tower traverse brace tube 356. A lower trip spring bracket 416 is coupled to the lower tower adjustment brackets 354. See FIGS. 13, 14 and 23.

Coupled to the traverse brace tube 200 are lift cylinder mounts 206. Lift cylinder mounts 206 are aligned to couple the lower end of the lift cylinder 142 which is coupled to the upper lift cylinder mount 140 on the lift bar 134.

Each of the side members 196, 198 of the plow frame 170 include an adjustment lug 172 at the rear portion 177 of the plow frame 170. Each adjustment lug 172 includes a plurality of orifices 179 aligned vertically and configured to receive a bolt 232 which will couple the plow frame 170 to the lift bar lugs 138 on the lift bar assembly 130. As best seen in FIGS. 12, 12A, 12B, and 12C, the adjustment lug 172 is received between each of the lift bar lugs 138 of the lift bar assembly 130 and secured with a bolt 232. In order to adjust the plow frame height relative to the vehicle, an operator will select one of the vertical adjustment orifices 179 to properly align the plow frame 170 with the lift bar assembly 130 which is in turn coupled with the chassis couplers 108 of the hitch frame nose assembly 100.

Referring now to FIGS. 15-18, there is disclosed a plow tower 362 which is rotatably coupled to the front portion 175 of the plow frame 170. The plow tower 362 is received between the two horizontal blade pivot brackets 350 and coupled to the plow frame 170 with a horizontal blade pivot pin 370 inserted through the horizontal pivot orifice defined in each of the horizontal blade pivot brackets and the orifices 352 and 368 defined in the plow tower 362.

Figure 17:
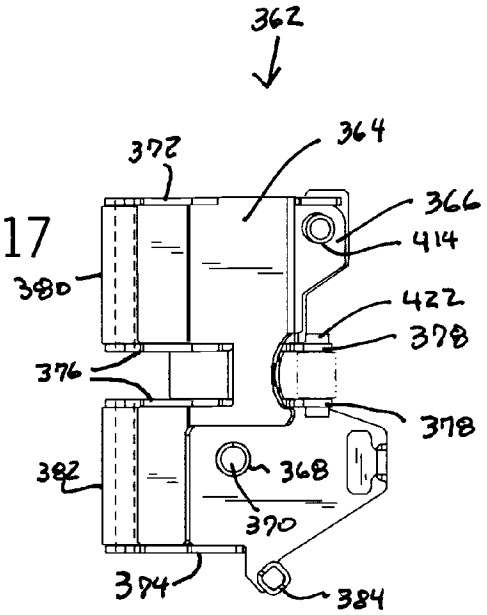
FIG. 17 is a side plan view of an exemplary embodiment of the plow tower illustrated in FIG. 16.
Figure 16:
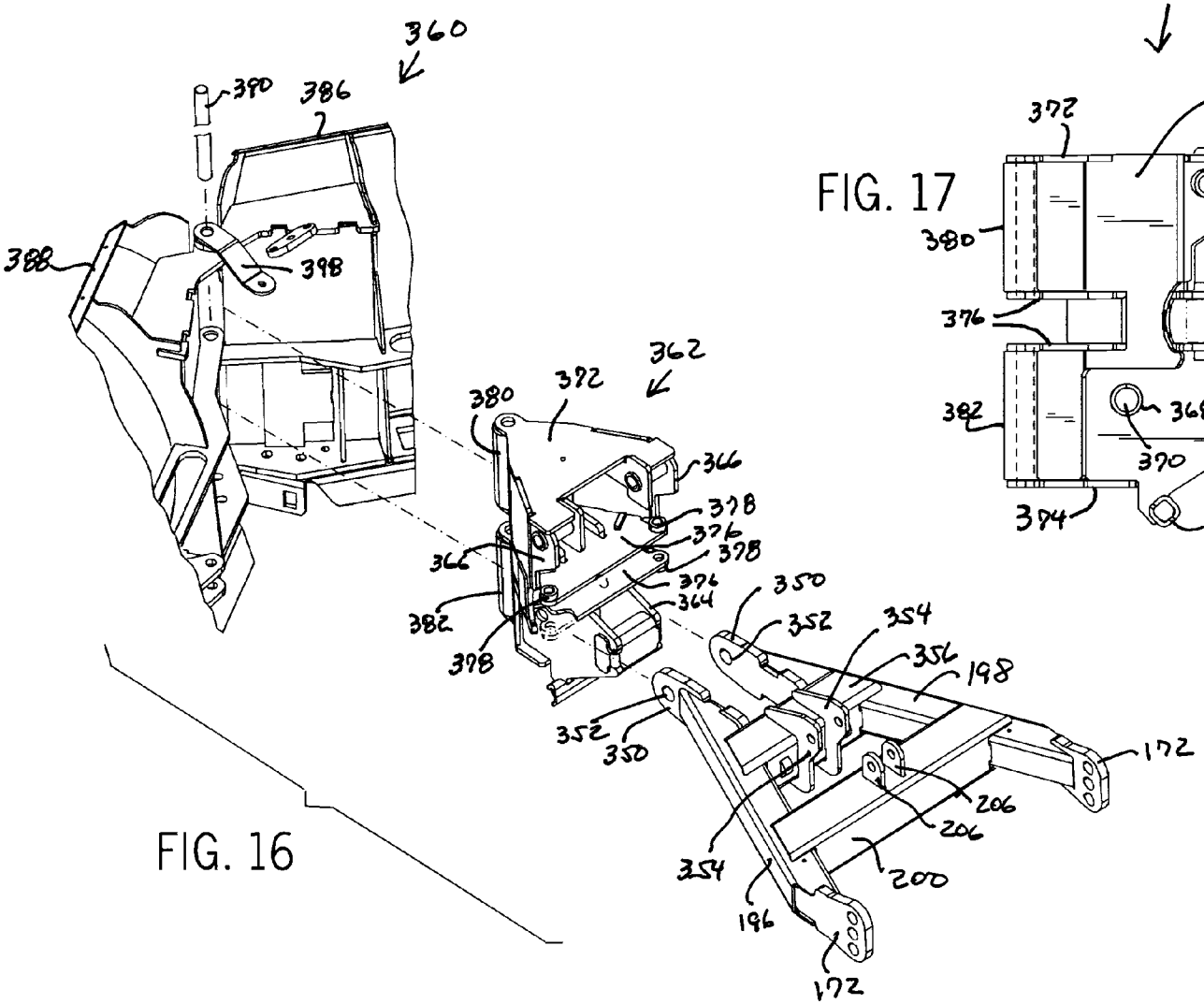
FIG. 16 is an exploded view of the plow frame, plow tower and portions of first and second V-blades illustrated in FIG. 15.
Figure 18:
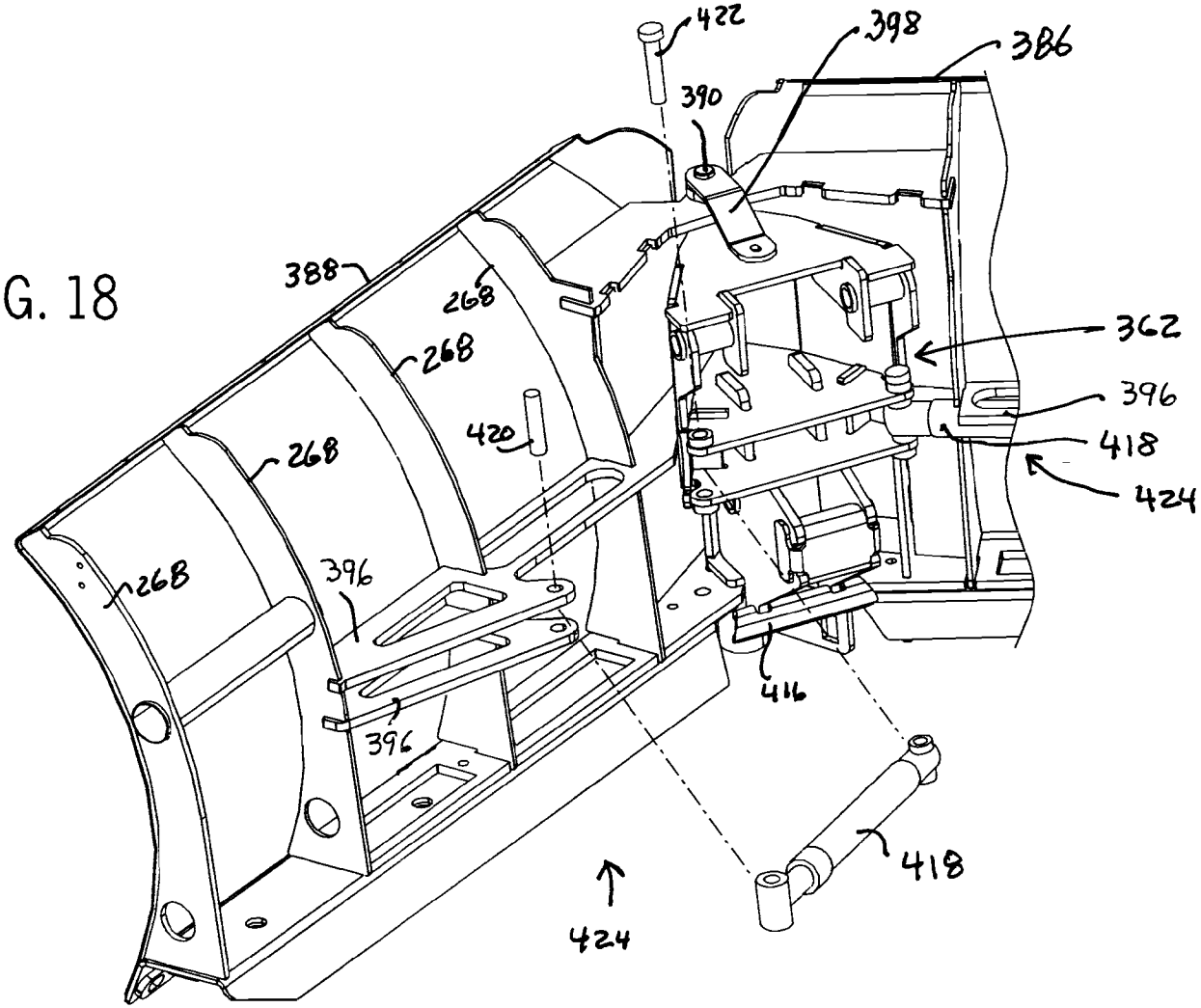
FIG. 18 is an isometric, rear view of one V-plow blade and partial V-plow blade coupled to the plow tower illustrated in FIG. 17 and illustrating an exemplary embodiment of a V-blade actuator.

The plow tower 362 is an assembly of two side plates 364 which are maintained in a triangular configuration by a top plate 372, a lower plate 374 and a pair of intermediate plates 376 as best illustrated in FIGS. 16, 17 and 18. Each of the side plates 364 further define an upper tower adjustment bracket 366, a blade stop 384 and the previously mentioned orifice 368 for the horizontal blade pivot in 370. Coupled between the upper plate 372 and one of the intermediate plates 376 is a blade upper vertical pivot tube 380. Coupled between the lower plate 374 and one of the intermediate blade plates 376 is a lower vertical pivot tube 382. Each of the vertical pivot tubes 380, 382 are coaxial and are positioned at the apex of the triangular-shaped plates, 372, 374, 376. Each of the intermediate plates 376 further define a V-blade swing cylinder bracket 378 which are configured to receive one end of a V-blade swing cylinder 418 and a V-blade swing cylinder pin 422. (See FIG. 17).

A first V-plow blade 386 and a second V-plow blade 388 are coupled together with a blade vertical pivot pin 390 which is received in each of the blade upper vertical pivot tube 380 and lower vertical pivot tube 382. A blade pivot pin tower strap 398 is coupled to the blade vertical pivot pin 390 and the top plate 372 of the plow tower 362.

Figure 24:
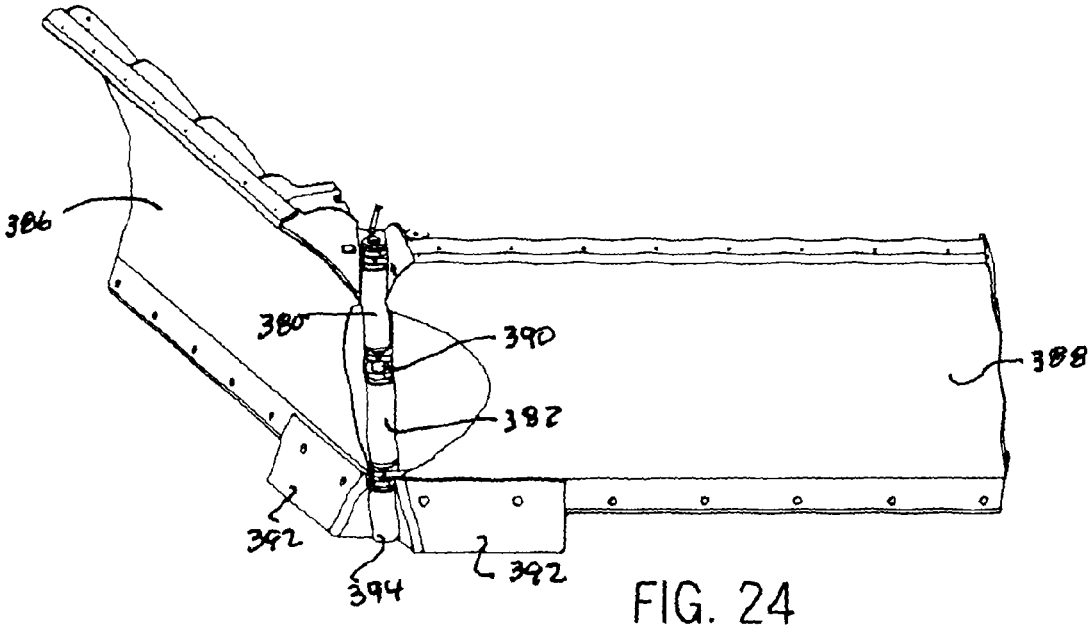
FIG. 24 is an isometric front view of the V-plow blade illustrated in FIG. 23.
Figure 25:
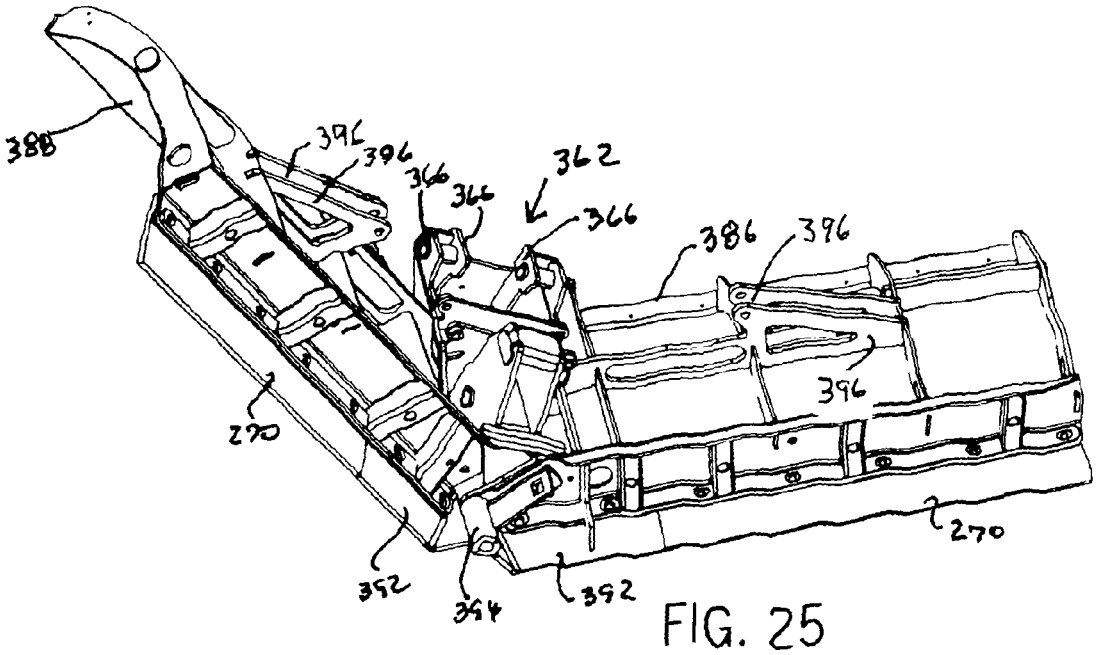
FIG. 25 is an isometric bottom, rear view of the V-plow blade illustrated in FIG. 24.

In a preferred embodiment the blade vertical pivot pin 390 is welded to the blade pivot pin tower strap 398. The orientation of the two V-plow blades 386 and 388 and the vertical pivot tubes 380 and 382 as seen at least in FIGS. 19 and 24 minimize a gap formed between the two blade segments 386, 388. This minimization of the gap inhibits material passing between the blades without requiring an overlap of the two blade segments or providing a cover in front of the hinge formed by the blade vertical pivot pin and the vertical pivot tubes 380, 382.

Each of the V-plow blades 386, 388 include a V-blade actuator 424 which moves each of the V-plow blades 386, 388 into positions as determined by an operator of the snow plow 50.

Each of the V-plow blade actuators 424 include a pair of blade swing cylinder brackets 396 which coupled to the respective V-plow blades 386, 388. One end of the swing cylinder 418 is coupled to the blade swing cylinder bracket 396 by a cylinder pivot pin 420. Another end of the swing cylinder 418 is coupled between each of the intermediate plates 376 by the V-blade swing cylinder pin 422. A fluid supply system (not shown) is coupled to each of the swing cylinders and other power actuators related to the snow plow 50. A preferred embodiment utilizes hydraulic fluid and cylinders.

FIG. 19 is a detailed view of the front of the V-plow assembly 360. A V-wearstrip 392 is coupled to each of the first and second V-plow blades 386, 388 approximate the center portion of the blade assembly. The V-wearstrip tube 394 is coupled to one of the V-wearstrips 392. It is contemplated that the wearstrip coupled to the tube 394 can be fabricated as part of the V-wearstrip 392 or it can be coupled to a V-wear 392 by, for example, welding. Each of the V-wearstrips 392 are bolted to each of the V-plow blades 386, 388. The blade vertical pivot pin 390 extends into the wearstrip through the tube 394 which completes the hinge for the two V-plow blades 386, 388.

Each of the swing cylinders 418 can move each of the V-plow blades 386, 388 into various configurations as determined by an operator of the snow plow 50. FIG. 20 is a cross-sectional top view through the line 20-20 as illustrated in FIG. 19 which shows the V-wearstrips 392 coupled to each of the V-plow blades 386, 387 with the plow blades in a swept back relationship.

FIG. 20 is the cross-sectional top view of the V-plow blades 386, 387 in a straight configuration. FIG. 22 is a cross-sectional top view of the V-plow blades 386, 388 in a swept forward configuration.

It should be noted that in each of the exemplary illustrated plow blade configurations shown in FIGS. 20, 21 and 22 the gap between the plow blades 386, 388 is minimal and effectively inhibits passage of material between the blade segments as the snow plow 50 is moved forward by the vehicle.

Figure 23:
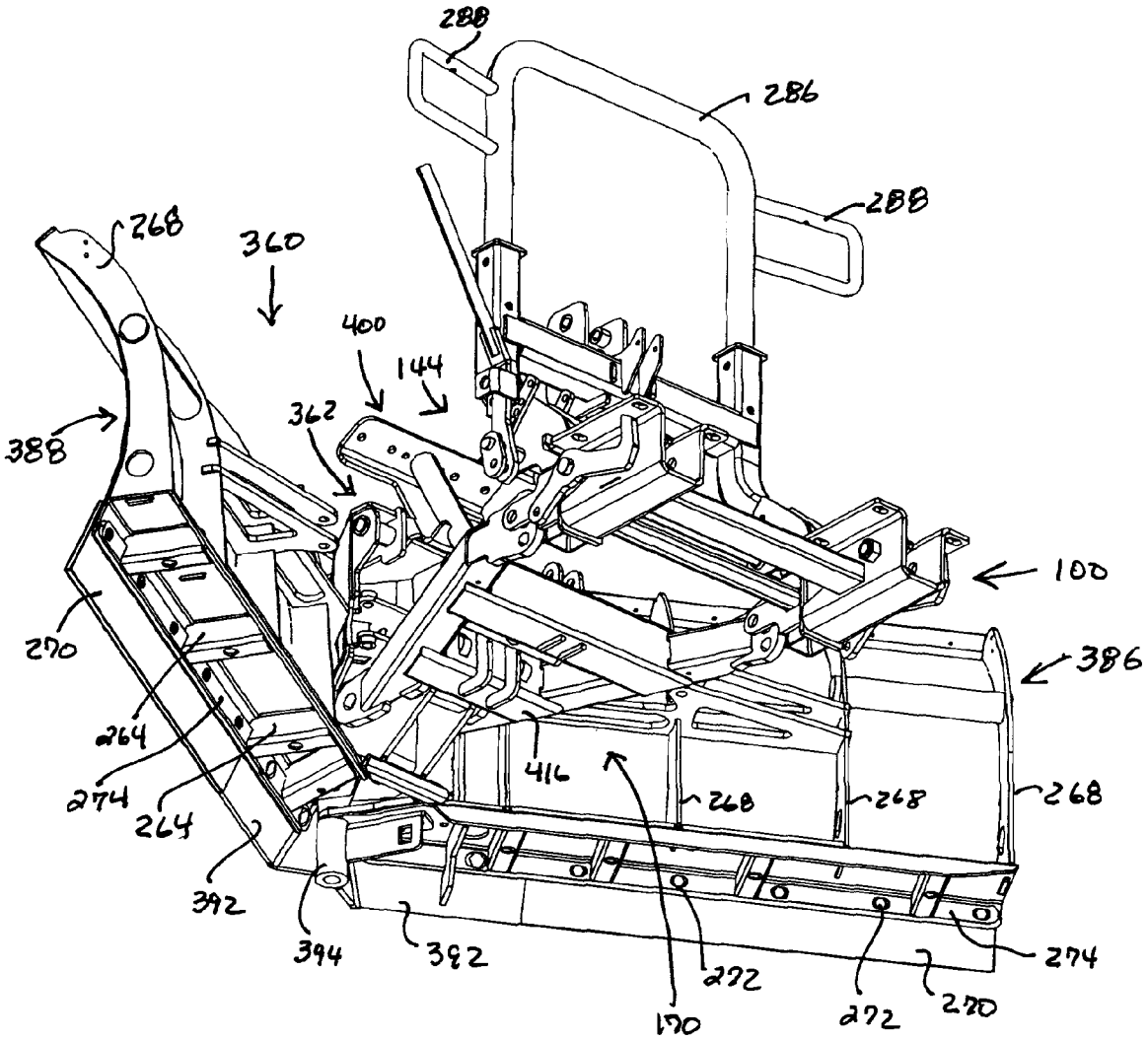
FIG. 23 is an isometric, back view of an exemplary embodiment of a V-plow coupled to the hitch mechanism illustrated in FIG. 3.
Figure 26B:
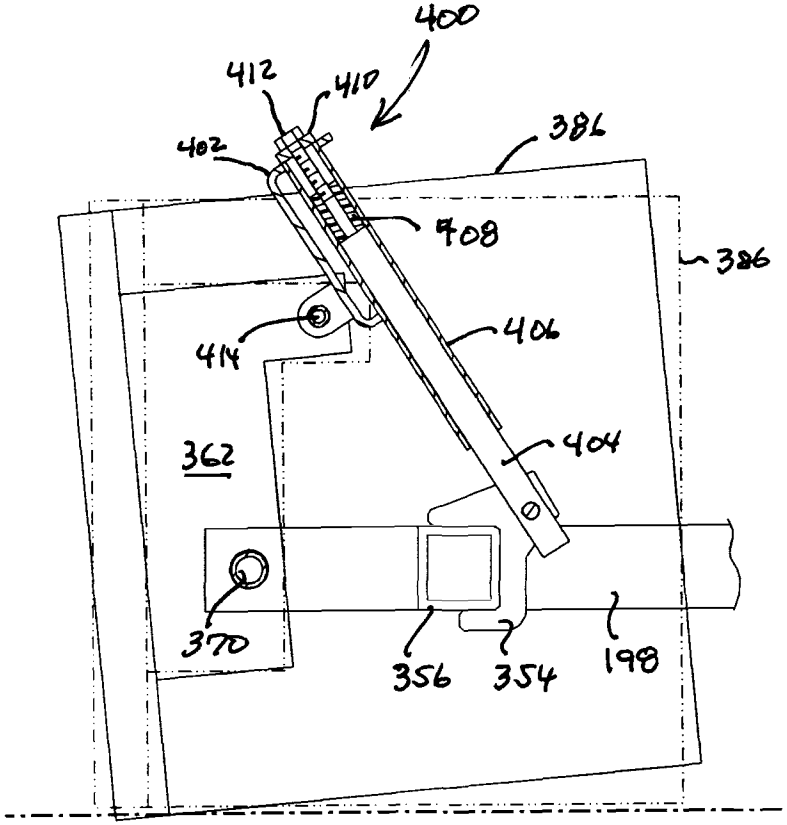
FIG. 26B is a schematic of the tower adjustment assembly rotating the V-plow blade about a horizontal blade pivot pin in the plow tower illustrated in FIG. 26A.
Figure 26A:
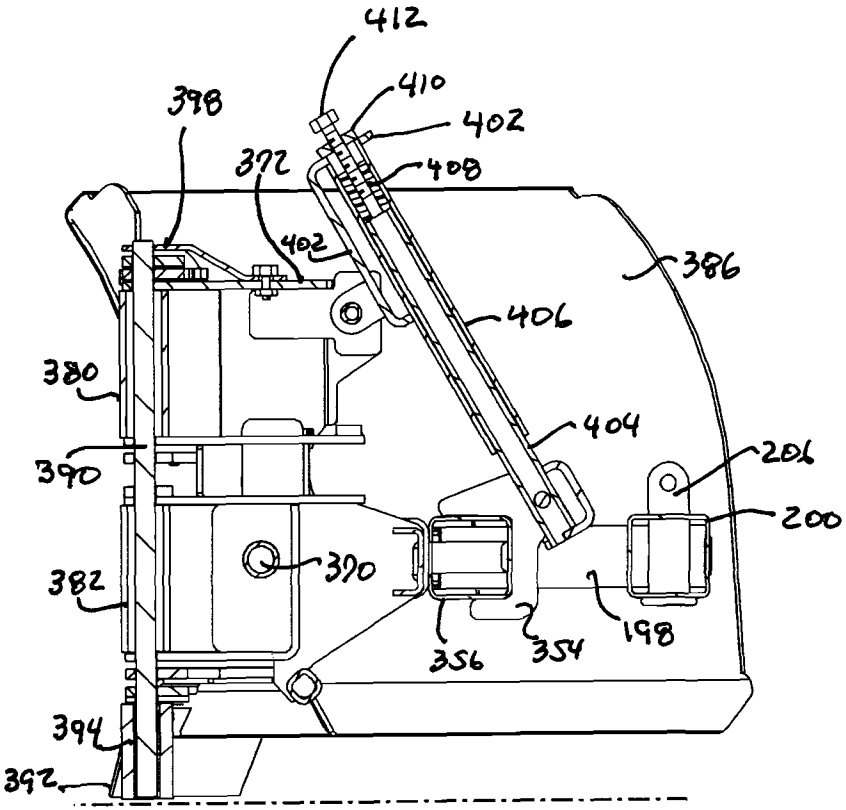
FIG. 26A is a cross sectional view along the line 26A-26A in FIG. 15 and illustrating the tower and tower adjustment assembly for a V-plow blade to maintain the lower edge of the blades in a horizontal aspect relative to the surface being cleaned.

FIG. 23 is rear isometric view of simply body of a V-plow snow plow 50. Each of the V-plow blades 386, 388 includes a plurality of plow ribs 268. Each of the plow ribs 268 are aligned vertically and coupled to a bottom plow frame member 262. The plow ribs 268 are positioned in evenly spaced intervals along the bottom plow frame member 262 and welded to the plow blade 250 in the bottom plow framed member. Each of the plow ribs 268 is configured in a concave curve to which the plow blade rib 268 conforms and which also facilitates movement of material, such as snow, as the plow 50 is operated. A wearstrip 270 is coupled to a substantial portion of the lower edge of each of the V-plow blades by a plurality of bolts 272 which extends through the wearstrip 270, the plow blade, the bottom plow frame member 262 and a nut plate 274 which is positioned against one of the downward extending flanges of the bottom plow frame member 262 (see at least FIG. 23). Reinforcement members 264 are positioned between the down facing flanges of the bottom plow frame member to reinforce the plow blade assembly. The reinforcement members 264 are typically welded to the bottom plow frame member 262. The top edge of the plow blade is bent and configured to be coupled to the top edge of each of the plow ribs 268. The top edge of the plow blade is typically welded to each of the plow ribs 268. As illustrated at least in FIGS. 15, 26*a* and 27 a tower adjustment assembly 400 is coupled to the plow tower 362 and the plow frame 170.

The tower adjustment assembly 400 includes a tower adjustment bracket 402 which is in a substantial T-shape. The top portion of the T-shape is coupled to an outer adjustment tube 406 at one end of the outer adjustment tube 406 and the lower portion of the T-shaped tower adjustment bracket 402 is also coupled to the outer adjustment tube 406 and is pivotally coupled to the plow tower 362 at the upper tower adjustment bracket 366 (see FIG. 17). A tower adjustment pin 414 secures the tower adjustment pivot bracket 402 on each side of the plow tower 362. An inner adjustment tube 404 is telescopically inserted into the outer adjustment tube 406 with the lower end of the inner adjustment tube 404 coupled to the lower tower adjustment bracket 352 on the tower traverse brace tube 352. The inner adjustment tube 404 does not extend throughout the full length of the outer adjustment tube 406. An adjustment cushion plug 408 is configured to fit within the inner diameter of the outer adjustment tube 406 and is inserted into the outer adjustment tube 406 between the inner adjustment tube 404 and the bolt bracket 410 coupled to the tower adjustment to the bracket 402. An adjustment bolt 412 is threadingly coupled to the adjustment cushion plug 408 through the bolt bracket 410. The adjustment cushion plug is preferably composed of a high density material such as polyurethane or other high density material.

In operation as the adjustment bolt 412 is turned, clockwise, into the inner and outer adjustment tube assembly. The adjustment bolt 412 pushes against the adjustment cushion plug 408 and forces the V-plow blades 386, 388 to pivot about the horizontal pivot pin 370 as illustrated schematically in FIG. 26*b*. The purpose of such adjustment is to maintain the lower edges of each of the V-plow blades 386, 388 in a substantially horizontal relationship to the surface which is being cleared of material by the plow 50. As the two segments of the V-plow are moved to various configurations (as described above) the outermost ends of each of the V-plows tend to move vertically relative to the plow hinge central section. The tower adjustment assembly counteracts such vertical movement and facilitates maintenance of a horizontal aspect of the lower edge of each of the blade segments.

Figure 27:
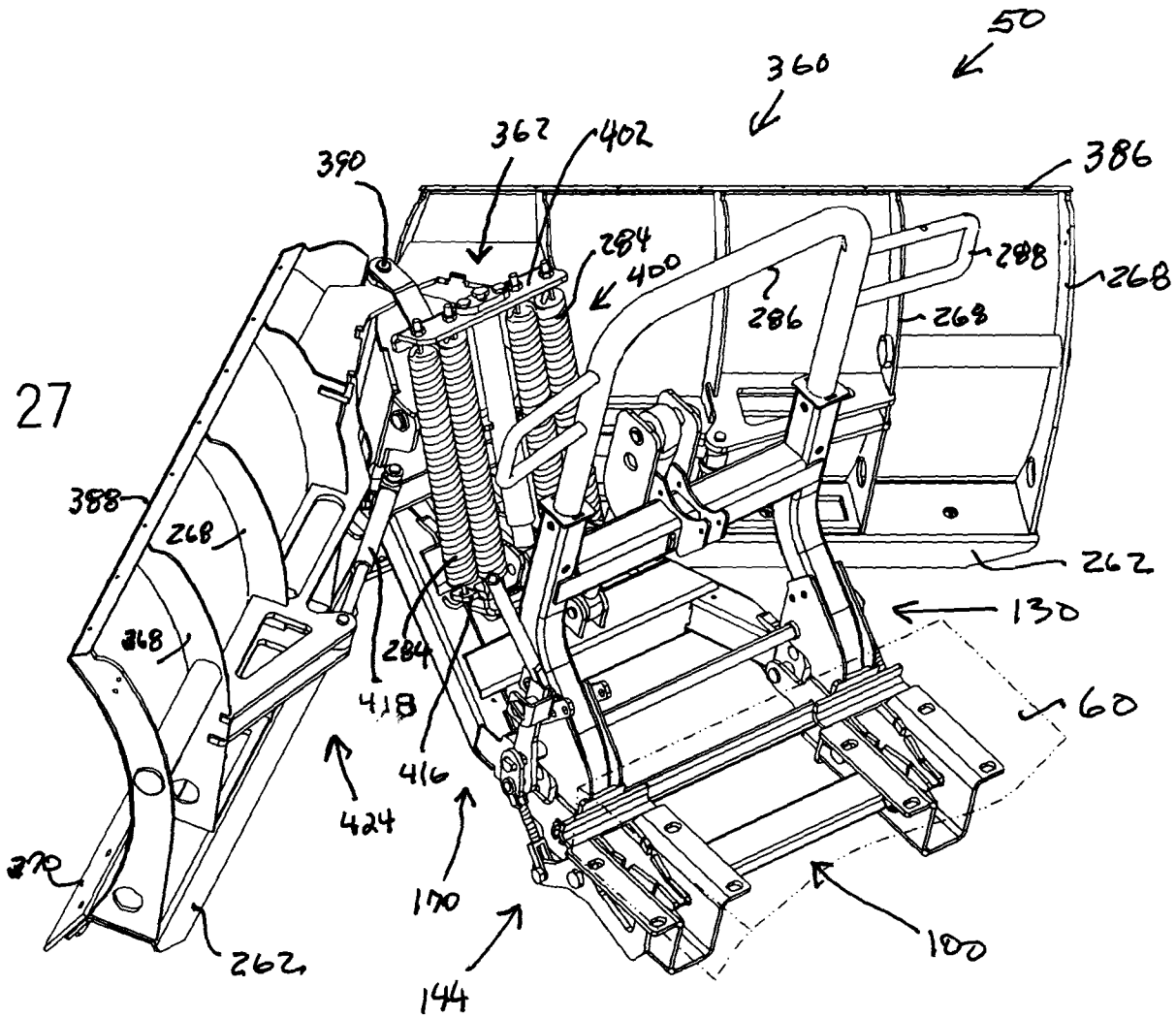
FIG. 27 is an isometric, assembly top view of an exemplary embodiment of the blade illustrated in FIG. 23.

As illustrated in FIG. 27, a plurality of trip springs 284 are coupled to each of the lower trip spring brackets 416 and the tower adjustment pivot bracket 402. FIG. 27 also illustrates a light bar 286 coupled to the lift bar support brackets 132. The light bar 286 supports a plurality of light brackets 288 to which plow lights (not shown) are coupled. Plow lights are typically needed since the snow plow 50 typically obstructs the headlights of the vehicle to which the snow plow is coupled. The trip springs 284 bias the plow tower 362 during operation of the plow 50 to return the V-plow blades 386, 388 to their operative position after the plow blade encounters an obstruction in the surface being cleared.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of a quick connect/disconnect hitch and a plow with independently moveable wings has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the hitch or plow as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A snow plow comprising:

a plow frame having a front portion and a rear portion;

a hitch apparatus configured to couple the rear portion of the plow frame to a vehicle;

a plow tower including a top portion and a bottom portion and being rotatably coupled proximate its bottom portion to the front portion of the plow frame by a horizontal pivot pin, the plow tower extending upwardly from the plow frame and being pivotable about a horizontal axis defined by the horizontal pivot pin which extends between right and left sides of the plow frame;

a first V-plow blade and a second V-plow blade, both pivotally coupled to the plow tower by a blade pivot pin, the plow tower configured to support each of the V-plow blades for movement about an axis defined by the blade pivot pin; and a tower adjustment assembly including an outer adjustment mechanism extending from a first end to a second end, the outer adjustment mechanism pivotally coupled to an upper portion of the plow tower, an inner adjustment mechanism extending from a first end to a second end, the first end being located inside of the outer adjustment mechanism between the first end and the second end of the outer adjustment mechanism, the inner adjustment mechanism being pivotally coupled to the plow frame, and an actuating mechanism including an adjustment bolt, the adjustment bolt being configured to be rotated in a first direction of rotation to cause the inner adjustment mechanism to move relative to the outer adjustment mechanism to pivotally displace the plow tower about the horizontal pivot pin in a first direction and to be rotated in a second rotational direction to cause the inner adjustment mechanism to move relative to the outer adjustment mechanism to pivotally displace the plow tower about the horizontal pivot pin in a second direction opposite the first direction.

2. The snow plow of claim 1, wherein the two V-plow blades are configured to move to a position selected from a group of positions consisting of swept-back, straight, and swept-forward.

3. The snow plow of claim 1, wherein the tower adjustment assembly comprises:

a tower adjustment bar coupled to the outer adjustment mechanism and pivotally coupled to the plow tower.

4. The snow plow of claim 3, additionally comprising:

an adjustment cushion plug disposed within the outer adjustment mechanism at least partially intermediate the adjustment bolt and the inner adjustment mechanism.

5. The snow plow of claim 1, additionally comprising:

an actuation mechanism coupled to each V-plow;

wherein the tower adjustment assembly includes an adjustment plug located in the outer adjustment mechanism, the adjustment plug configured to contact the adjustment bolt to transmit force from the actuating mechanism to the first end of the inner adjustment mechanism to pivotally displace the plow tower about the horizontal pivot pin.

6. The snow plow of claim 1, further comprising:

an adjustment lug coupled to each side of the rear portion of the plow frame, with each lug defining a plurality of orifices aligned vertically, wherein the height of the plow frame can be adjusted to a degree relative to the vehicle when the snow plow is coupled to the vehicle.

7. The snow plow of claim 1, further comprising a power mechanism configured to selectively raise and lower the front portion of the plow frame and the plow blade.

8. The snow plow of claim 1, further comprising:

a bank of trip springs having a first end and a second end spaced apart from the first end, the bank of trip springs being coupled proximate the first end to the intermediate portion of the plow frame and being coupled proximate the second end to the upper portion of the plow tower;

wherein, upon at least one of the V-plow blades encountering an obstruction, the bank of trip springs is configured to return the at least one V-plow blade to its operative position upon clearing of the obstruction.

9. The snow plow of claim 1, additionally comprising:

a first swing element and a second swing element, each swing element having a first end and a second end, the first end of the first swing element being coupled with the plow tower, the second end of the first swing element being coupled with the first V-plow blade, the first end of the second swing element being coupled with the plow tower, the second end of the second swing element being coupled with the second V-plow blade, the plow tower configured to support each of the V-plow blades for movement by the swing elements about the blade pivot pin.

10. The snow plow of claim 9, wherein the tower adjustment assembly is configured to adjust the orientation of the V-plow blades, the plow tower, and the swing elements together about the horizontal pivot pin.

11. A snow plow comprising:

a plow frame having a front portion, a rear portion, and an intermediate portion located between the front and rear portions of the plow frame, the plow frame being configured to be attached to a vehicle at a height that is at least in part determined by the height of the vehicle;

a plow tower including an upper portion and a lower portion, the plow tower extending upwardly from the plow frame;

a horizontal pivot pin pivotally coupling the lower portion of the plow tower to the front portion of the plow frame;

a first V-plow blade and a second V-plow blade, both pivotally coupled to the plow tower by a pivot pin; and a tower adjustment assembly configured to manually adjust the plow tower and the first and second V-plow blades about the horizontal pivot pin and to maintain the plow tower and the first and second V-plow blades in the adjusted configuration during operation, the tower adjustment assembly having an outer adjustment tube having a first end and a second end and an inner adjustment member having a first end and a second end, the first end of the of the inner adjustment member being located at least partially within the outer adjustment tube, wherein one of the outer adjustment tube and the inner adjustment member are pivotally coupled to the plow tower, the tower adjustment assembly including an adjustment bolt extending into the first end of the outer adjustment tube, the adjustment bolt being configured to be rotated in a first rotational direction to move the pivot pin in a first direction and to be rotated in a second rotational direction to move the pivot pin in a second direction to allow a user to adjust the orientation of the pivot pin when the snow plow is coupled to the vehicle.

12. The snow plow of claim 11, wherein the other of the adjustment tube and the adjustment member is pivotally coupled to a location intermediate the front portion of the plow frame and the rear portion of the plow frame; and wherein the tower adjustment assembly includes an intermediate member located between the inner adjustment member and the adjustment bolt, configured to transmit force from the adjustment bolt to displace the inner adjustment member relative to the outer adjustment tube, to adjust the length of the tower adjustment assembly.

13. The snow plow of claim 12, wherein the adjustment bolt engages the intermediate member.

14. The snow plow of claim 11, further comprising:

at least one trip spring having a first end and a second end spaced apart from the first end, the at least one trip spring being coupled proximate the first end to an intermediate portion of the plow frame and being coupled proximate the second end to the upper portion of the plow tower;

wherein, upon at least one of the V-plow blades encountering an obstruction, the bank of trip springs is configured to return the at least one V-plow blade to its operative position upon clearing of the obstruction.

15. The snow plow of claim 12, wherein the intermediate member includes an adjustment cushion plug disposed within the outer adjustment tube at least partially intermediate the adjustment bolt and the inner adjustment member.

16. The snow plow of claim 15, wherein the adjustment cushion plug is comprised of a high density material.

* * * * *